US011713773B2

(12) United States Patent
Avedon

(10) Patent No.: US 11,713,773 B2
(45) Date of Patent: Aug. 1, 2023

(54) COLUMNAR AIR MOVING DEVICES, SYSTEMS AND METHODS

(71) Applicant: AIRIUS IP HOLDINGS, LLC, Longmont, CO (US)

(72) Inventor: Raymond B. Avedon, Boulder, CO (US)

(73) Assignee: Airius IP Holdings, LLC, Longmont, CO (US)

( * ) Notice: Subject to any disclaimer, the term of this patent is extended or adjusted under 35 U.S.C. 154(b) by 0 days.

(21) Appl. No.: 17/646,053

(22) Filed: Dec. 27, 2021

(65) Prior Publication Data

US 2022/0220975 A1 Jul. 14, 2022

Related U.S. Application Data

(63) Continuation of application No. 16/926,269, filed on Jul. 10, 2020, now Pat. No. 11,236,766, which is a (Continued)

(51) Int. Cl.
*F04D 29/54* (2006.01)
*F04D 13/06* (2006.01)
(Continued)

(52) U.S. Cl.
CPC ..... *F04D 29/547* (2013.01); *F04D 13/06* (2013.01); *F04D 19/002* (2013.01);
(Continued)

(58) Field of Classification Search
CPC ..... F04D 25/088; F04D 29/44; F04D 29/441; F04D 29/444; F04D 29/54; F04D 29/522;
(Continued)

(56) References Cited

U.S. PATENT DOCUMENTS 651,637 A 6/1900 Nicol
D33,522 S 11/1900 Brinkerhoff
(Continued)

FOREIGN PATENT DOCUMENTS

AU 2013203632 11/2016
CN 1426729 7/2003
(Continued)

OTHER PUBLICATIONS

"Airius Model R20 EC 'Eyeball' Data Sheet", http://airius.com.au/products/new-retail-series-2/attachment/na_std_retailseries/ published Jun. 15, 2016 as printed May 23, 2017 in page 1.
(Continued)

*Primary Examiner* — Peter J Bertheaud
(74) *Attorney, Agent, or Firm* — Knobbe, Martens, Olson & Bear, LLP

(57) ABSTRACT

An air moving device includes a housing member, an impeller assembly, and a nozzle assembly. The nozzle assembly can include one or more angled vanes set an angle with respect to a central axis of the air moving device. The air moving device can output a column of moving air having an oblong and/or rectangular cross-section. A dispersion pattern of the column of moving air upon the floor of an enclosure in which the air moving device is installed can have an oblong and/or rectangular shape. The dimensions of the dispersion pattern may be varied by moving the air moving device toward or away from the floor, and/or by changing the angles of the stator vanes within the nozzle assembly.

16 Claims, 12 Drawing Sheets

Related U.S. Application Data continuation of application No. 16/250,426, filed on Jan. 17, 2019, now Pat. No. 10,724,542, which is a continuation of application No. 14/729,905, filed on Jun. 3, 2015, now Pat. No. 10,221,861.

(60) Provisional application No. 62/008,776, filed on Jun. 6, 2014.

(51) Int. Cl.

| | |
|---|---|
| ***F04D 25/06*** | (2006.01) |
| ***F24F 7/06*** | (2006.01) |
| ***F24F 7/013*** | (2006.01) |
| ***F04D 19/00*** | (2006.01) |
| ***F04D 25/08*** | (2006.01) |
| ***F04D 29/52*** | (2006.01) |

(52) U.S. Cl.

CPC ..... *F04D 25/0606* (2013.01); *F04D 25/08* (2013.01); *F04D 25/088* (2013.01); *F04D 29/522* (2013.01); *F04D 29/541* (2013.01); *F04D 29/542* (2013.01); *F04D 29/544* (2013.01); *F24F 7/013* (2013.01); *F24F 7/06* (2013.01); *F24F 7/065* (2013.01)

(58) Field of Classification Search

CPC .... F04D 29/541; F04D 29/542; F04D 29/544; F04D 29/545; F04D 29/547; F04D 29/601; F04D 19/002; F04D 13/06; F04D 25/0606; F04D 25/08; F24F 7/007; F24F 7/013; F24F 7/06; F24F 7/065

See application file for complete search history.

(56) References Cited

U.S. PATENT DOCUMENTS

| | | | |
|---|---|---|---|
| 818,604 | A | 4/1906 | Bierd |
| 866,292 | A | 9/1907 | Meston |
| 917,206 | A | 4/1909 | Watts |
| 1,858,067 | A | 5/1932 | Warren |
| 1,877,347 | A | 9/1932 | McCurdie |
| 1,926,795 | A | 9/1933 | Sassenberg |
| 2,016,778 | A | 10/1935 | Hall et al. |
| 2,142,307 | A | 1/1939 | De Mey et al. |
| 2,144,035 | A | 1/1939 | Smith, Jr. |
| 2,154,313 | A | 4/1939 | McMahan |
| 2,189,008 | A | 2/1940 | Kurth |
| 2,189,502 | A | 2/1940 | Johnston |
| 2,232,573 | A | 2/1941 | Teves |
| 2,258,731 | A | 10/1941 | Blumenthal |
| D133,120 | S | 7/1942 | Spear |
| 2,300,574 | A | 11/1942 | Jepertinger |
| 2,359,021 | A | 9/1944 | Campbell et al. |
| 2,366,773 | A | 1/1945 | Eklund et al. |
| 2,371,821 | A | 3/1945 | Havis |
| D152,397 | S | 1/1949 | Damond |
| 2,513,463 | A | 7/1950 | Eklund et al. |
| 2,524,974 | A | 10/1950 | Hickmott |
| 2,615,620 | A | 10/1952 | Goettl |
| 2,632,375 | A | 3/1953 | Stair et al. |
| 2,658,719 | A | 11/1953 | Johanson |
| D174,230 | S | 3/1955 | Lewis, II |
| 2,710,337 | A | 6/1955 | Moore, Jr. |
| 2,814,433 | A | 11/1957 | Brinen |
| 2,830,523 | A | 4/1958 | Vehige |
| D187,699 | S | 4/1960 | van Rijn |
| 2,982,198 | A | 5/1961 | Mohrman |
| 3,012,494 | A | 12/1961 | Drummond |
| 3,036,509 | A | 5/1962 | Babbitt |
| 3,040,993 | A | 6/1962 | Schultz |
| 3,068,341 | A | 12/1962 | Ortiz et al. |
| 3,072,321 | A | 1/1963 | King, Jr. |
| D195,287 | S | 5/1963 | Downing |
| 3,099,949 | A | 8/1963 | Davidson |
| 3,165,294 | A | 1/1965 | Anderson |
| 3,188,007 | A | 6/1965 | Myklebust |
| 3,212,425 | A | 10/1965 | Lindner et al. |
| 3,246,699 | A | 4/1966 | Jocz |
| 3,300,123 | A | 1/1967 | Freyholdt et al. |
| 3,306,179 | A | 2/1967 | Lambie et al. |
| 3,320,869 | A | 5/1967 | Schach |
| 3,364,839 | A | 1/1968 | Sweeney et al. |
| 3,382,791 | A | 5/1968 | Baud |
| 3,386,368 | A | 6/1968 | Fielding |
| 3,413,905 | A | 12/1968 | Johnson |
| 3,524,399 | A | 8/1970 | Bohanon |
| 3,584,968 | A | 6/1971 | Keith |
| 3,601,184 | A | 8/1971 | Hauville |
| 3,690,244 | A | 9/1972 | Kallel et al. |
| 3,699,872 | A | 10/1972 | Kruger |
| 3,765,317 | A | 10/1973 | Lowe |
| 3,785,271 | A | 1/1974 | Joy |
| 3,827,342 | A | 8/1974 | Hughes |
| D232,831 | S | 9/1974 | Vidmar, Jr. |
| 3,835,759 | A | 9/1974 | LLoyd |
| D234,847 | S | 4/1975 | Hoffman |
| 3,876,331 | A | 4/1975 | Herder et al. |
| 3,927,300 | A | 12/1975 | Wada et al. |
| 3,932,054 | A | 1/1976 | McKelvey |
| 3,934,494 | A | 1/1976 | Butler |
| 3,967,927 | A | 7/1976 | Patterson |
| 3,973,479 | A | 8/1976 | Whiteley |
| 3,988,973 | A | 11/1976 | Honmann |
| 4,006,673 | A | 2/1977 | Meyer et al. |
| D246,467 | S | 11/1977 | Kurata |
| 4,064,427 | A | 12/1977 | Hansen et al. |
| 4,123,197 | A | 10/1978 | Keem et al. |
| D251,851 | S | 5/1979 | Palm |
| 4,152,973 | A | 5/1979 | Peterson |
| 4,162,779 | A | 7/1979 | Van Steenhoven et al. |
| 4,185,545 | A | 1/1980 | Rusth et al. |
| D255,488 | S | 6/1980 | Kanarek |
| 4,210,833 | A | 7/1980 | Neveux |
| D256,273 | S | 8/1980 | Townsend et al. |
| 4,234,916 | A | 11/1980 | Goralnik |
| D258,010 | S | 1/1981 | Bowls et al. |
| D258,526 | S | 3/1981 | Nederman |
| 4,261,255 | A | 4/1981 | Anderson et al. |
| 4,321,659 | A | 3/1982 | Wheeler |
| 4,344,112 | A | 8/1982 | Brown |
| D269,638 | S | 7/1983 | Frye, Jr. et al. |
| 4,391,570 | A | 7/1983 | Stutzman |
| 4,396,352 | A | 8/1983 | Pearce |
| D272,184 | S | 1/1984 | Karpowicz |
| D273,793 | S | 5/1984 | Nachatelo |
| D274,772 | S | 7/1984 | Obland |
| 4,473,000 | A | 9/1984 | Perkins |
| 4,512,242 | A | 4/1985 | Bohanon, Sr. |
| 4,515,538 | A | 5/1985 | Shih |
| 4,522,255 | A | 6/1985 | Baker |
| 4,524,679 | A | 6/1985 | Lyons |
| 4,546,420 | A | 10/1985 | Wheeler et al. |
| 4,548,548 | A | 10/1985 | Gray, III |
| 4,550,649 | A | 11/1985 | Zambolin |
| D283,054 | S | 3/1986 | Altman |
| 4,630,182 | A | 12/1986 | Moroi et al. |
| 4,657,483 | A | 4/1987 | Bede |
| 4,657,485 | A | 4/1987 | Hartwig |
| 4,662,912 | A * | 5/1987 | Perkins ..... F24F 8/10 55/467 |
| 4,678,410 | A | 7/1987 | Kullen |
| 4,681,024 | A | 7/1987 | Ivey |
| D291,488 | S | 8/1987 | Delmas |
| 4,692,091 | A | 9/1987 | Ritenour |
| D293,029 | S | 12/1987 | Shwisha |
| 4,714,230 | A | 12/1987 | Huang |
| 4,715,784 | A | 12/1987 | Mosiewicz |
| 4,716,818 | A | 1/1988 | Brown |
| 4,730,551 | A | 3/1988 | Peludat |
| 4,750,863 | A | 6/1988 | Scoggins |
| 4,790,863 | A | 12/1988 | Nobiraki et al. |
| 4,794,851 | A | 1/1989 | Kurrle |

(56) References Cited

U.S. PATENT DOCUMENTS 4,796,343 A 1/1989 Wing
4,848,669 A 7/1989 George
4,850,265 A 7/1989 Raisanen
4,890,547 A 1/1990 Wagner et al.
4,895,065 A 1/1990 Lamparter
D308,416 S 6/1990 Brumbach
4,930,987 A 6/1990 Stahl
4,971,143 A 11/1990 Hogan
4,973,016 A 11/1990 Hertenstein
D312,875 S 12/1990 Spock
D314,619 S 2/1991 Beavers et al.
5,000,081 A 3/1991 Gilmer
5,021,932 A 6/1991 Ivey
5,033,711 A 7/1991 Gregorich et al.
5,042,366 A 8/1991 Panetski et al.
5,060,901 A 10/1991 Lathrop et al.
5,078,574 A 1/1992 Olsen
5,094,676 A 3/1992 Karbacher
D325,628 S 4/1992 Cho
5,107,755 A 4/1992 Leban et al.
5,121,675 A 6/1992 Muller et al.
5,127,876 A 7/1992 Howe et al.
D328,405 S 8/1992 Heiligenstein et al.
5,152,606 A 10/1992 Borraccia et al.
5,156,568 A 10/1992 Ricci
5,191,618 A 3/1993 Hisey
D335,532 S 5/1993 Lopez
D337,157 S 7/1993 Ortiz
D340,765 S 10/1993 Joss et al.
5,251,461 A 10/1993 Fallows, III et al.
D347,467 S 5/1994 Medvick
5,328,152 A 7/1994 Castle
5,358,443 A 10/1994 Mitchell et al.
5,399,119 A 3/1995 Birk et al.
5,423,660 A 6/1995 Sortor
5,429,481 A 7/1995 Liu
5,439,349 A 8/1995 Kupferberg
5,439,352 A 8/1995 Line
5,443,625 A 8/1995 Schaffhausen
5,458,505 A 10/1995 Prager
5,462,484 A 10/1995 Jung et al.
5,466,120 A 11/1995 Takeuchi et al.
5,484,076 A 1/1996 Petrushka
5,511,942 A 4/1996 Meier
5,513,953 A 5/1996 Hansen
5,520,515 A 5/1996 Bailey et al.
5,545,241 A 8/1996 Vanderauwera et al.
5,547,343 A 8/1996 Jané et al.
5,551,841 A 9/1996 Kamada
5,561,952 A 10/1996 Damron
5,569,019 A 10/1996 Katariya et al.
5,584,656 A 12/1996 Rose
5,595,068 A 1/1997 Amr
5,613,833 A 3/1997 Wolfe et al.
5,658,196 A 8/1997 Swaim
5,664,872 A 9/1997 Spearman et al.
D386,267 S 11/1997 Tickner
5,709,458 A 1/1998 Metz
5,725,190 A 3/1998 Cuthbertson et al.
5,725,356 A 3/1998 Carter
5,782,438 A 7/1998 Hubben et al.
5,791,985 A 8/1998 Schiedegger et al.
5,822,186 A 10/1998 Bull
D404,617 S 1/1999 Mick et al.
D407,696 S 4/1999 Shimazu
5,918,972 A 7/1999 Van Belle
5,934,783 A 8/1999 Yoshikawa
5,938,527 A 8/1999 Oshima et al.
D414,550 S 9/1999 Bloom
5,947,816 A 9/1999 Schiedegger et al.
5,967,891 A 10/1999 Riley et al.
5,975,853 A 11/1999 Lackey
5,984,252 A 11/1999 Bograng et al.
5,997,253 A 12/1999 Feehan
6,004,097 A 12/1999 Wark et al.
6,068,385 A 5/2000 Hsieh
D427,673 S 7/2000 Stout, Jr.
6,095,671 A 8/2000 Hutain
6,109,874 A 8/2000 Steiner
6,145,798 A 11/2000 Janisse et al.
6,149,513 A 11/2000 Lyu
6,155,782 A 12/2000 Hsu
6,168,517 B1 1/2001 Cook
6,176,680 B1 1/2001 Ringblom et al.
6,183,203 B1 2/2001 Grintz
6,192,702 B1 2/2001 Shimogori
6,193,384 B1 2/2001 Stein
6,196,915 B1 3/2001 Schiedegger et al.
D443,053 S 5/2001 Schaefer
6,319,304 B1 11/2001 Moredock
D453,960 S 2/2002 Shelby et al.
6,352,473 B1 3/2002 Clark
6,357,714 B1 3/2002 Johnson
6,360,816 B1 3/2002 Wagner
6,361,428 B1 3/2002 Tosconi et al.
6,361,431 B1 3/2002 Kawano
6,364,760 B1 4/2002 Rooney
D457,142 S 5/2002 Chang
D457,452 S 5/2002 Christiansen
D457,613 S 5/2002 Schaefer
6,382,911 B1 5/2002 Beltowski
6,383,072 B2 5/2002 Schiedegger et al.
6,384,494 B1 5/2002 Avidano et al.
6,386,828 B1 5/2002 Davis et al.
6,386,970 B1 5/2002 Vernier, II et al.
6,386,972 B1 5/2002 Schiedegger et al.
6,435,964 B1 8/2002 Chang
6,451,080 B1 9/2002 Rocklitz et al.
6,458,028 B2 10/2002 Snyder
6,458,628 B1 10/2002 Distefano et al.
6,484,524 B1 11/2002 Ulanov
D470,066 S 2/2003 Christiansen
D470,731 S 2/2003 Hipgrave et al.
6,551,185 B1 4/2003 Miyake et al.
6,575,011 B1 6/2003 Busby
6,581,974 B1 6/2003 Ragner et al.
6,582,291 B2 6/2003 Clark
6,592,328 B1 7/2003 Cahill
6,595,747 B2 7/2003 Bos
D480,132 S 9/2003 Stout, Jr.
6,626,003 B1 9/2003 Kortüm et al.
6,626,636 B2 9/2003 Bohn
D481,101 S 10/2003 Boehrs et al.
D481,127 S 10/2003 Hayamizu
D481,159 S 10/2003 Walker
6,648,752 B2 11/2003 Vernier, II et al.
6,679,433 B2 1/2004 Gordon et al.
6,682,308 B1 1/2004 Fei et al.
6,700,266 B2 3/2004 Winkel et al.
D489,967 S 5/2004 Funk
6,761,531 B2 7/2004 Toye
6,767,281 B2 7/2004 McKee
6,783,578 B2 8/2004 Tillman, Jr.
6,804,627 B1 10/2004 Marokhovsky et al.
6,805,627 B2 10/2004 Marts et al.
6,812,849 B1 11/2004 Ancel
D500,773 S 1/2005 Colson et al.
D505,627 S 5/2005 Py et al.
6,886,270 B2 5/2005 Gilmer
6,916,240 B1 7/2005 Morton
6,938,631 B2 9/2005 Gridley
6,941,698 B2 9/2005 Telles
6,951,081 B2 10/2005 Bonshor
6,966,830 B2 11/2005 Hurlstone et al.
6,974,381 B1 12/2005 Walker et al.
D514,688 S 2/2006 Avedon
7,011,500 B2 3/2006 Matson
7,011,578 B1 3/2006 Core
7,044,849 B2 5/2006 Dippel
7,048,499 B2 5/2006 Mathson et al.
7,056,092 B2 6/2006 Stahl
7,056,368 B2 6/2006 Moredock et al.
D525,725 S 7/2006 Foo
7,101,064 B2 9/2006 Ancel

(56) References Cited

U.S. PATENT DOCUMENTS

D532,229 S 11/2006 Hoernig et al.
7,152,425 B2 12/2006 Han et al.
7,166,023 B2 1/2007 Haigh et al.
7,175,309 B2 2/2007 Craw et al.
7,185,504 B2 3/2007 Kasai et al.
7,201,110 B1 4/2007 Pawlak
7,201,650 B2 4/2007 Demerath et al.
7,214,035 B2 5/2007 Bussieres et al.
7,246,997 B2 7/2007 Liu et al.
D552,485 S 10/2007 Grabiner et al.
7,287,738 B2 10/2007 Pitlor
7,288,023 B2 10/2007 Leopold
D557,791 S 12/2007 Cox
7,311,492 B2 12/2007 Östberg
7,320,636 B2 1/2008 Seliger et al.
7,331,764 B1 2/2008 Reynolds et al.
D564,120 S 3/2008 Layne et al.
D567,930 S 4/2008 Smith
D567,961 S 4/2008 Yajima
7,374,408 B2 5/2008 Savage et al.
D570,981 S 6/2008 McClelland
7,381,129 B2 * 6/2008 Avedon ..... F04D 29/542 416/247 R
D578,390 S 10/2008 Green
D582,502 S 12/2008 Brittingham
D583,451 S 12/2008 Aloe et al.
D583,452 S 12/2008 Aloe et al.
7,467,931 B2 12/2008 O'Toole
D584,786 S 1/2009 Brittingham
7,473,074 B2 1/2009 Herbst et al.
7,476,079 B2 1/2009 Bartlett
7,484,863 B1 2/2009 Aubrey
7,497,773 B1 3/2009 Schmidt
D591,382 S 4/2009 Brittingham
7,516,578 B2 4/2009 Bonshor
7,544,124 B2 6/2009 Polston
7,549,258 B2 6/2009 Lajewski
7,566,034 B2 7/2009 Bonshor
D599,471 S 9/2009 Borovicka et al.
D600,396 S 9/2009 Luinstra
7,607,935 B2 10/2009 Dahl
D604,880 S 11/2009 Lovegrove
7,610,717 B2 11/2009 Lüken et al.
7,610,726 B2 11/2009 Lajewski
D605,332 S 12/2009 Miranda
7,645,188 B1 1/2010 Peerbolt
7,651,390 B1 1/2010 Profeta et al.
D612,925 S 3/2010 Kameyama et al.
7,677,770 B2 3/2010 Mazzochette
7,677,964 B1 3/2010 Bucher et al.
7,708,625 B2 5/2010 Leseman et al.
7,717,674 B2 5/2010 Tsuji et al.
D617,890 S 6/2010 Thomas
D620,096 S 7/2010 Underwood
7,748,954 B2 7/2010 Eguchi et al.
7,752,814 B2 7/2010 Bonshor
D621,985 S 8/2010 Sanoner
D622,895 S 8/2010 Lyons
7,774,999 B2 8/2010 McKee
7,780,510 B2 8/2010 Polston
7,785,064 B2 8/2010 Bartholmey et al.
D625,855 S 10/2010 Franklin
D625,856 S 10/2010 Franklin
7,849,644 B2 12/2010 Melesky
D630,337 S 1/2011 Chia et al.
D630,536 S 1/2011 Pettit
D631,142 S 1/2011 Angell
D631,148 S 1/2011 Benton et al.
D631,579 S 1/2011 Franklin
D631,580 S 1/2011 Franklin
D631,581 S 1/2011 Franklin
7,901,278 B2 3/2011 O'Hagin
7,930,858 B2 4/2011 Lajewski
7,942,627 B2 5/2011 Jin
D645,550 S 9/2011 Ferroni
D645,561 S 9/2011 Herrmann et al.
D645,593 S 9/2011 Janssen
8,052,386 B1 11/2011 Fitzpatrick et al.
D651,709 S 1/2012 Zeyfang
D651,919 S 1/2012 Lai et al.
D651,920 S 1/2012 Lai et al.
D661,902 S 6/2012 Italiano
8,215,789 B2 7/2012 Howard
8,282,138 B2 10/2012 Steiner
8,297,945 B2 10/2012 Spaggiari
D672,863 S 12/2012 Romero Carreras
D676,877 S 2/2013 Drenth et al.
1,053,025 A1 2/2013 Goodwin
8,366,387 B2 2/2013 Reuter
D678,791 S 3/2013 Ford
D681,184 S 4/2013 Romero Carreras
D684,307 S 6/2013 Teller
8,459,846 B2 6/2013 Tsao
8,487,517 B2 7/2013 Fang et al.
8,529,324 B2 9/2013 Moredock et al.
8,535,128 B2 9/2013 Chwala
8,596,596 B2 12/2013 Naji et al.
8,616,842 B2 12/2013 Avedon
D698,916 S 2/2014 Avedon
8,641,375 B2 2/2014 Tian et al.
D702,887 S 4/2014 Peiruccelli
D703,302 S 4/2014 Ruck
D703,579 S 4/2014 Kuster et al.
D709,643 S 7/2014 Kohler et al.
D710,485 S 8/2014 Nudo
D710,490 S 8/2014 Shurtleff
D711,843 S 8/2014 Yamazaki et al.
D714,996 S 10/2014 Trotter et al.
D715,904 S 10/2014 Tate et al.
8,894,354 B2 11/2014 Hodgson et al.
8,899,930 B2 12/2014 Innocenti et al.
D721,645 S 1/2015 Brown
8,931,936 B1 1/2015 Tham et al.
D722,486 S 2/2015 Wang
D724,199 S 3/2015 Bambot et al.
D725,053 S 3/2015 Kaneko et al.
D725,055 S 3/2015 Yamazaki et al.
8,967,983 B2 3/2015 Kampf
8,992,174 B2 3/2015 Chang
D730,185 S 5/2015 Blanco et al.
9,028,085 B2 5/2015 Todd, Jr.
9,028,211 B2 5/2015 Todd, Jr.
D731,030 S 6/2015 Tyler
D733,555 S 7/2015 Brady et al.
D739,223 S 9/2015 Paik et al.
D739,515 S 9/2015 Johnson et al.
D739,832 S 9/2015 Yamazaki et al.
D740,973 S 10/2015 Gonzalez
9,151,295 B2 10/2015 Avedon
D742,508 S 11/2015 Row et al.
D742,563 S 11/2015 Kasha
D743,521 S 11/2015 Jackson
D746,416 S 12/2015 Barlar
D746,971 S 1/2016 Avedon
D747,453 S 1/2016 Stewart et al.
D752,339 S 3/2016 Hoover
D753,817 S 4/2016 Maguire et al.
D753,818 S 4/2016 Maguire et al.
D754,312 S 4/2016 Ellis
D755,438 S 5/2016 Kimmet
D756,494 S 5/2016 Gledhill et al.
D756,498 S 5/2016 Norman et al.
9,335,061 B2 5/2016 Avedon
D758,642 S 6/2016 Eguchi
D760,384 S 6/2016 Niunoya et al.
D761,419 S 7/2016 Fitzgerald et al.
D766,098 S 9/2016 Seo
D766,100 S 9/2016 Jung
D768,844 S 10/2016 Koseoglu
9,459,020 B2 10/2016 Avedon
D772,531 S 11/2016 Troia
D774,689 S 12/2016 Terumichi
D775,719 S 1/2017 Smith et al.
D777,311 S 1/2017 Chen

(56) References Cited

U.S. PATENT DOCUMENTS

D783,795 S 4/2017 Avedon
9,631,627 B2 4/2017 Avedon
D788,886 S 6/2017 Salzer
D788,953 S 6/2017 Khan
9,696,026 B1 7/2017 Hardgrave
9,702,576 B2 7/2017 Avedon
9,714,663 B1 7/2017 Avedon
D794,198 S 8/2017 Mizumura et al.
D794,199 S 8/2017 Mizumura et al.
D798,718 S 10/2017 Foster et al.
D799,014 S 10/2017 Suarez et al.
D799,675 S 10/2017 Wong
D800,174 S 10/2017 Ghalsasi et al.
D801,510 S 10/2017 O'Connett et al.
D801,545 S 10/2017 Wiesli et al.
D803,381 S 11/2017 Kim et al.
D805,176 S 12/2017 Avedon
D818,185 S 5/2018 Wilson
9,970,457 B2 5/2018 Avedon
D820,967 S 6/2018 Avedon
10,024,531 B2 7/2018 Avedon
D824,716 S 8/2018 Elgamil et al.
D825,090 S 8/2018 Richardson et al.
D831,484 S 10/2018 Jung et al.
D835,265 S 12/2018 Inoue
D836,238 S 12/2018 Ericson, Jr. et al.
D838,379 S 1/2019 Trump
10,184,489 B2 1/2019 Avedon
D840,009 S 2/2019 Suarez et al.
D841,452 S 2/2019 Conselvan
D844,126 S 3/2019 Sheng et al.
D844,128 S 3/2019 Li
10,221,861 B2 3/2019 Avedon
D845,461 S 4/2019 Li
D845,462 S 4/2019 Li
D847,967 S 5/2019 Hernandez et al.
D848,295 S 5/2019 Johnson et al.
D850,727 S 6/2019 Petruccelli
D852,143 S 6/2019 Ku
D853,017 S 7/2019 Rioux et al.
D861,979 S 10/2019 Sibley
D862,795 S 10/2019 Caldas
D865,223 S 10/2019 Spork et al.
D865,907 S 11/2019 Wagner
D868,254 S 11/2019 Lintula et al.
10,487,840 B2 11/2019 Avedon
10,487,852 B2 11/2019 Avedon
D869,275 S 12/2019 Taunk
D870,778 S 12/2019 Johnson
D871,535 S 12/2019 Ferrer
D872,911 S 1/2020 Chen
D877,917 S 3/2020 Schill
D880,098 S 3/2020 Harrison et al.
D881,374 S 4/2020 Schoettle
D885,550 S 5/2020 Avedon
10,641,506 B2 5/2020 Avedon
10,655,841 B2 5/2020 Avedon
D886,275 S 6/2020 Avedon
D887,541 S 6/2020 Avedon
10,724,542 B2 7/2020 Avedon
D895,784 S 9/2020 Wang
11,053,948 B2 7/2021 Avedon
D926,963 S 8/2021 Avedon
11,092,330 B2 8/2021 Avedon
11,105,341 B2 8/2021 Avedon
11,221,153 B2 1/2022 Avedon
11,236,766 B2 2/2022 Avedon
D953,517 S 5/2022 Belozerova et al.
11,365,743 B2 6/2022 Avedon
11,421,710 B2 8/2022 Avedon
2001/0049927 A1 12/2001 Toepel
2002/0045420 A1 4/2002 Taillon
2002/0131865 A1 9/2002 Larzelere et al.
2002/0137454 A1 9/2002 Baker
2003/0026691 A1 2/2003 Huang et al.
2003/0092373 A1 5/2003 Kuo
2003/0213883 A1 11/2003 Fu-Liang
2004/0004173 A1 1/2004 Johnson
2004/0050077 A1 3/2004 Kasai et al.
2004/0052641 A1 3/2004 Chen
2004/0240214 A1 12/2004 Whitlow et al.
2004/0253095 A1 12/2004 Sasaki et al.
2005/0045793 A1 3/2005 Johnson et al.
2005/0077446 A1 4/2005 Bacon et al.
2005/0092888 A1 5/2005 Gonce
2005/0159101 A1 7/2005 Hrdina et al.
2006/0087810 A1 4/2006 Rockenfeller
2006/0146542 A1 7/2006 Sullivan
2006/0172688 A1 8/2006 Johnson
2006/0193139 A1 8/2006 Sun et al.
2006/0276123 A1 12/2006 Sanagi et al.
2006/0278766 A1 12/2006 Wang
2006/0284435 A1 12/2006 Vitito
2007/0213003 A1 9/2007 Railkar et al.
2007/0231145 A1 10/2007 Jin
2007/0246579 A1 10/2007 Blateri
2007/0297906 A1 12/2007 Wu
2007/0297912 A1 12/2007 Reuter
2008/0019836 A1 1/2008 Butz et al.
2008/0061200 A1 3/2008 Bouissiere
2008/0188175 A1 8/2008 Wilkins
2008/0227381 A1 9/2008 Avedon
2009/0041580 A1 2/2009 Wichmann et al.
2009/0122516 A1 5/2009 Yang
2009/0155080 A1 6/2009 Yu
2009/0170421 A1 7/2009 Adrian et al.
2009/0219727 A1 9/2009 Weaver
2009/0262550 A1 10/2009 Inoue
2010/0009621 A1 1/2010 Hsieh
2010/0052495 A1 3/2010 Liu et al.
2010/0075588 A1 3/2010 Haneline
2010/0111698 A1 5/2010 Wiedman et al.
2010/0176706 A1 7/2010 Fu et al.
2010/0192611 A1 8/2010 Yamaguchi et al.
2010/0202932 A1 8/2010 Danville
2010/0232168 A1 9/2010 Horng
2010/0295436 A1 11/2010 Horng et al.
2010/0328881 A1 12/2010 Huang
2010/0329885 A1 12/2010 Criner et al.
2011/0037368 A1 2/2011 Huang
2011/0057551 A1 3/2011 Lee et al.
2011/0057552 A1 3/2011 Weaver
2011/0080096 A1 4/2011 Dudik et al.
2011/0084586 A1 4/2011 Lain et al.
2011/0133622 A1 6/2011 Mo et al.
2011/0140588 A1 6/2011 Chen
2011/0223016 A1 9/2011 Ediger et al.
2011/0228967 A1 9/2011 Kulchy et al.
2012/0060453 A1 3/2012 Holzmann et al.
2012/0062095 A1 3/2012 Horng
2012/0194054 A1 8/2012 Johnston
2012/0195749 A1 8/2012 Avedon
2013/0111721 A1 5/2013 Mahfoudh et al.
2013/0196588 A1 8/2013 Liao
2014/0314560 A1 10/2014 Avedon
2014/0348634 A1 11/2014 Bourrilhon et al.
2015/0021013 A1 1/2015 Batarseh
2015/0176834 A1 6/2015 Avedon
2016/0107200 A1 4/2016 Al-Shafei et al.
2016/0146222 A1 5/2016 Avedon
2017/0370363 A1 12/2017 Avedon
2018/0149161 A1 5/2018 Avedon
2018/0149380 A1 5/2018 Avedon
2018/0335049 A1 11/2018 Gu et al.
2019/0010961 A1 1/2019 Kumaou
2019/0011121 A1 1/2019 Avedon
2020/0166053 A1 5/2020 Avedon
2020/0217530 A1 7/2020 Avedon
2020/0232470 A1 7/2020 Avedon
2020/0333027 A1 10/2020 Avedon
2021/0007449 A1 1/2021 Udagawa
2021/0040960 A1 2/2021 Shih et al.
2021/0277914 A1 9/2021 Lu et al.
2021/0348617 A1 11/2021 Avedon

(56) References Cited

U.S. PATENT DOCUMENTS

| | | | |
|---|---|---|---|
| 2021/0396248 | A1 | 12/2021 | Gao |
| 2022/0042522 | A1 | 2/2022 | Avedon |
| 2022/0120469 | A1 | 4/2022 | Doat et al. |
| 2023/0055245 | A1 | 2/2023 | Avedon |

FOREIGN PATENT DOCUMENTS

| | | |
|---|---|---|
| CN | 101592328 | 12/2009 |
| CN | 201560963 | 8/2010 |
| DE | 44 13 542 | 10/1995 |
| DE | 196 38 518 | 4/1998 |
| DE | 10 2008 044874 | 3/2010 |
| EP | 0 037 958 | 10/1981 |
| EP | 0 212 749 | 3/1987 |
| EP | 0 772 007 | 5/1997 |
| EP | 2 248 692 | 11/2010 |
| FR | 0 715 101 | 11/1931 |
| FR | 2 784 423 | 4/2000 |
| GB | 190617978 | 5/1907 |
| GB | 0 792 369 | 3/1958 |
| GB | 0 824 390 | 11/1959 |
| GB | 0 981 188 | 1/1965 |
| GB | 1 251 880 | 11/1971 |
| GB | 2 344 619 | 6/2000 |
| GB | 2 468 504 | 9/2010 |
| JP | 55-032965 | 3/1980 |
| JP | 61-502267 | 10/1986 |
| JP | 01-067548 | 3/1989 |
| JP | 07-167097 | 7/1995 |
| JP | 07-253231 | 10/1995 |
| JP | 08-219939 | 8/1996 |
| JP | 11-132543 | 5/1999 |
| JP | 2001-193979 | 7/2001 |
| JP | 2002-349489 | 12/2002 |
| JP | 2006-350237 | 12/2006 |
| JP | 2010-181124 | 8/2010 |
| KR | 20-0176664 | 4/2000 |
| KR | 2003-0025428 | 3/2003 |
| KR | 10-1255739 | 4/2013 |
| RU | 2400254 C2 | 9/2010 |
| TW | M337636 | 8/2008 |
| WO | WO 01/034983 | 5/2001 |
| WO | WO 03/040572 | 5/2003 |
| WO | WO 2005/091896 | 10/2005 |
| WO | WO 2006/078102 | 7/2006 |
| WO | WO 2008/062319 | 5/2008 |
| WO | WO 2010/046536 | 4/2010 |
| WO | WO 2010/114702 | 10/2010 |
| WO | WO 2011/067430 | 6/2011 |
| WO | WO 2012/174155 | 12/2012 |
| WO | WO 2012/174156 | 12/2012 |
| WO | WO 2015/187856 | 12/2015 |
| WO | WO 2016/081693 | 5/2016 |
| WO | WO 2020/214729 | 10/2020 |

OTHER PUBLICATIONS

Keeler Hardware, "OC Oval Cylinder Escutcheon", https://www.keelerhardware.com.au/products/oc-oval-cylinder-escutcheon as printed Nov. 13, 2017 in 3 pages.

"The New Airius Q50 EC", https://web.archive.org/web/20150721185407/http://airius.com.au/technical/specification-sheets/the-new-airius-q50-ec/ as archived Jul. 21, 2015, pp. 2.

* cited by examiner

COLUMNAR AIR MOVING DEVICES, SYSTEMS AND METHODS

RELATED APPLICATIONS

This application is a continuation of U.S. application Ser. No. 16/926,269 filed Jul. 10, 2020, titled COLUMNAR AIR MOVING DEVICES, SYSTEMS AND METHODS, which is a continuation of U.S. application Ser. No. 16/250,426, filed Jan. 17, 2019, titled COLUMNAR AIR MOVING DEVICES, SYSTEMS AND METHODS, now U.S. Pat. No. 10,724,542, which is a continuation of U.S. application Ser. No. 14/729,905, filed Jun. 3, 2015, titled COLUMNAR AIR MOVING DEVICES, SYSTEMS AND METHODS, now U.S. Pat. No. 10,221,861 issued on Mar. 5, 2019, which claims the benefit of U.S. Provisional Application No. 62/008,776, filed Jun. 6, 2014, titled COLUMNAR AIR MOVING DEVICES, SYSTEMS AND METHODS. The entire contents of the above-identified patent applications are incorporated by reference herein and made a part of this specification for all purposes. Any and all priority claims identified in the Application Data Sheet, or any correction thereto, are hereby incorporated by reference under 37 CFR § 1.57.

FIELD OF THE INVENTIONS

The present application relates generally to systems, devices and methods for moving air that are particularly suitable for creating air temperature de-stratification within a room, building, or other structure.

DESCRIPTION OF THE RELATED ART

The rise of warm air and the sinking of cold air can create significant variation in air temperatures between the ceiling and floor of buildings with conventional heating, ventilation and air conditioning systems. Air temperature stratification is particularly problematic in large spaces with high ceilings such as grocery stores, warehouses, gymnasiums, offices, auditoriums, hangers, commercial buildings, residences with cathedral ceilings, agricultural buildings, and other structures, and can significantly increase heating and air conditioning costs. Structures with both low and high ceiling rooms can often have stagnant or dead air, as well, which can further lead to air temperature stratification problems.

SUMMARY

An aspect of at least one of the embodiments disclosed herein includes the realization that it can be desirable to de-stratify air in a localized manner. For example, it is desirable to de-stratify air between coolers or freezer aisles in a grocery store setting without moving warm air directly onto the coolers or freezers.

Therefore, it would be advantageous to not only have an air de-stratification device that is designed to de-stratify the air in a room and reduce pockets of high temperature near the ceiling, but also to have an air de-stratification device that directs air in a localized, elongate pattern. De-stratifying air in a localized, elongate pattern could permit use of fewer air moving devices in a given aisle or other narrow area while reducing the amount of air passage to areas adjacent the aisle of narrow area. In some embodiments, de-stratifying air in such a pattern can reduce overall energy requirements to maintain a given temperature in the aisles or other narrow areas of a grocery store or other enclosure.

In some cases, de-stratifying air in an elongate pattern can warm the environment in the aisles (e.g., freezer aisles) of a grocery store while reducing or eliminating movement of air directly onto freezers or other refrigeration devices adjacent to the aisles. Warming up the aisles of a grocery store can increase comfort for shoppers and, thus allows for more time for the shopper to spend in the aisles actually buying products. Increasing the time shoppers spend in the grocery aisles can increase sales for the entire grocery store.

In some embodiments, de-stratifying air in the aisles of a freezer or refrigeration section of a grocery store can reduce or eliminate fogging or other condensation on the display windows of the freezer or refrigerator units. In some cases, de-stratifying the air in these aisles can dry up water on the floor of the aisle. Drying the aisle floors can reduce hazards in the grocery store and/or reduce the store's exposure to liability due to the condensation from the windows which may cause a slippery floor.

Thus, in accordance with at least one embodiment described herein, a columnar air moving device can include a housing. The housing can have a first end and a second end. In some embodiments, the housing has a longitudinal axis extending between the first end and the second end. The air moving device can include an impeller. The impeller can be rotatably mounted within the housing adjacent the first end of the housing. In some embodiments, the impeller has one or more rotor blades capable of directing a volume of air toward the second end of the housing. In some cases, the impeller is configured to rotate about an axis (e.g., a rotational axis) parallel or coincident to the longitudinal axis of the housing. The air moving device can include a nozzle. The nozzle can be mounted in the housing between the impeller and the second end of the housing. The nozzle can have an inlet with a circular cross-section. In some embodiments, the nozzle has an outlet with an oblong cross-section. The oblong cross-section can have a major axis and a minor axis. In some cases, one or more stator vanes are positioned within the nozzle. In some embodiments, at least one of the stator vanes has a first end at or adjacent to the inlet of the nozzle and a second end at or adjacent to the outlet of the nozzle. In some embodiments, the first end of the at least one stator vane is positioned closer to the longitudinal axis of the housing than the second end of the at least one stator vane.

According to some variants, a gap between a downstream edge of the rotor blades and an upstream edge of one or more of the stator vanes is less than one half of a diameter of the impeller. In some cases, one of the stator vanes is parallel to and positioned along the longitudinal axis of the housing. In some embodiments, the air moving device comprises an inner housing positioned at least partially within the housing, wherein the two one or more stator vanes are positioned within the inner housing. The air moving device can include a hanger capable of attaching to the air moving device. The hanger can be configured to facilitate attachment of the air moving device to a ceiling or other structure. In some embodiments, the hanger is hingedly attached to the air moving device. In some embodiments, the air moving device includes an inlet cowl comprising a curved surface configured to reduce generation of turbulence at the first end of the housing. In some cases, a length of the minor axis of the outlet of the nozzle is less than ⅓ of a length of the major axis of the outlet of the nozzle. In some embodiments, a cross-sectional area of the outlet of the nozzle is less than the cross-sectional area of the inlet of the nozzle.

A method of de-stratifying air within an enclosure can include positioning an air moving device above a floor of the enclosure. The air moving device can have a longitudinal axis. In some embodiments, the air moving device includes a nozzle mounted in the housing between the impeller and the second end of the housing. The nozzle can have an inlet with a circular cross-section and an outlet with an oblong cross-section. In some embodiments, the oblong cross-section has a major axis and a minor axis. The cross-section (e.g., circular cross-section) of the inlet can have a greater area than the cross-section (e.g., oblong cross-section) of the outlet. In some cases, the method includes actuating an impeller of the air moving device, the impeller having a rotational axis substantially parallel to or coincident the longitudinal axis of the air moving device. The method can include directing an oblong column of air toward the floor from the air moving device, the oblong column of air having a major axis and a minor axis, the major axis of the oblong column of air being greater than the minor axis of the oblong column of air. In some embodiments, the method includes moving the air moving device toward or away from the floor to vary a cross-sectional area of a portion of the oblong column of air which impinges upon the floor. According to some variants, the method includes changing an angle of a stator vane within the nozzle to change the length of the major axis of the oblong column of air.

In accordance with at least one embodiment of the present disclosure, an air moving device can include a housing. The housing can have a first end, a second end, and a longitudinal axis extending between the first end and the second end. In some cases, the device includes an impeller. The impeller can be rotatably mounted within the housing. In some embodiments, the impeller is mounted adjacent the first end of the housing. The impeller can have one or more rotor blades capable of directing a volume of air toward the second end of the housing. In some embodiments, the impeller is configured to rotate about a rotational axis. In some cases, the device includes a nozzle. The nozzle can be connected to the housing. In some cases, the nozzle is connected to the housing between the impeller and the second end of the housing. The nozzle can have an inlet and an outlet. The outlet can have an oblong cross-section. In some embodiments, the oblong cross-section has a major axis and a minor axis. The device can include one or more stator vanes. The one or more stator vanes can be positioned within the nozzle. In some embodiments, at least one of the stator vanes has a first end at or adjacent to the inlet of the nozzle and a second end at or adjacent to the outlet of the nozzle. In some embodiments, the first end of the at least one stator vane is positioned closer to the longitudinal axis of the housing than the second end of the at least one stator vane. In some embodiments, a cross-sectional shape of the inlet of the nozzle is different from the cross-section of the outlet of the nozzle.

In some embodiments, a gap between a downstream edge of the rotor blades and an upstream edge of one or more of the stator vanes is less than one half of a diameter of the impeller. In some cases, one of the stator vanes is parallel to and positioned along the longitudinal axis of the housing. In some embodiments, the device comprises an inner housing positioned at least partially within the housing. In some cases, the one or more stator vanes are positioned within the inner housing. In some embodiments, the air moving device includes a hanger capable of attaching to the air moving device. The hanger can be configured to facilitate attachment of the air moving device to a ceiling or other structure. In some embodiments, the hanger is hingedly attached to the air moving device. Preferably, the air moving device includes an inlet cowl comprising a curved surface configured to reduce generation of turbulence at the first end of the housing. In some embodiments, a length of the minor axis of the outlet of the nozzle is less than a length of the major axis of the outlet of the nozzle. In some cases, a cross-sectional area of the outlet of the nozzle is less than a cross-sectional area of the inlet of the nozzle. In some cases, the inlet of the nozzle has an elliptical shape. In some embodiments, the inlet of the nozzle has a circular shape. In some embodiments, the nozzle decreases in cross-sectional area from the inlet to the outlet.

According to at least one embodiment of the present disclosure, a method of de-stratifying air within an enclosure can include utilizing an air moving device above a floor of the enclosure. The air moving device can have a longitudinal axis. In some embodiments, the air moving device includes a nozzle. The nozzle can be mounted in the housing. In some embodiments, the nozzle is mounted in the housing between the impeller and the second end of the housing. In some cases, the nozzle has an inlet with a circular cross-section. In some embodiments, the nozzle has an outlet with an oblong cross-section. The oblong cross-section can have a major axis and a minor axis. In some embodiments, the circular cross-section of the inlet can have a greater area than the oblong cross-section of the outlet. In some cases, the method includes actuating an impeller of the air moving device. The impeller can have a rotational axis substantially parallel to the longitudinal axis of the air moving device. The method can include directing an oblong column of air toward the floor from the air moving device. The oblong column of air can have a major axis and a minor axis. The major axis of the oblong column of air can be greater than the minor axis of the oblong column of air.

According to some variants, the method includes changing an angle of a stator vane within the nozzle to change a length of the major axis of the oblong column of air. The method can include moving the air moving device toward or away from the floor to vary a cross-sectional area of a portion of the oblong column of air which impinges upon the floor.

In accordance with at least one embodiment of the present disclosure, an air moving device can include an impeller assembly. The impeller assembly can have an inlet end and an outlet end. The impeller assembly can include an impeller. The impeller can be positioned between the inlet end and the outlet end. The impeller can have a first impeller blade and a second impeller blade. In some embodiments, the impeller has an axis of rotation wherein rotation of the first and second impeller blades about the axis of rotation draws air into the inlet end of the impeller assembly and pushes air out of the outlet end of the impeller assembly. The air moving device can include a nozzle assembly. The nozzle assembly can be positioned downstream from the outlet end of the impeller assembly. In some embodiments, the nozzle assembly has a nozzle housing. The nozzle housing can have a nozzle inlet and a nozzle outlet positioned further from the impeller assembly than the nozzle inlet. The nozzle housing can define a nozzle interior between the nozzle inlet and the nozzle outlet. In some embodiments, the nozzle assembly includes a nozzle axis. The nozzle assembly can include a first stator vane. The first stator vane can be positioned at least partially within the nozzle interior. In some embodiments, the first stator vane has an upstream end and a downstream end. The nozzle assembly can include a second stator vane. The second stator vane can be positioned at least partially within the nozzle interior. In some embodiments, the second stator vane has an upstream end and a downstream end. In some cases, the upstream end of the first stator vane is bent at a first angle with respect to the nozzle axis. Preferably, the upstream end of the second stator vane is bent at a second end with respect to the nozzle axis. In some embodiments, the first angle is less than the second angle.

According to some variants, the nozzle outlet has an oblong cross-section as measured perpendicular to the nozzle axis. In some configurations, the air moving device includes a third stator vane. The third stator vane can be positioned at least partially within the nozzle interior. The third stator vane can have an upstream end and a downstream end. In some embodiments, the upstream end of the third stator vane is bent at a third angle with respect to the nozzle axis. Preferably, the third angle is greater than the second angle. In some cases, the downstream end of the second stator vane is parallel to the nozzle axis. In some embodiments, the air moving device includes a fourth stator vane. The fourth stator vane can be positioned at least partially within the nozzle interior. In some embodiments, the fourth stator vane has an upstream end and a downstream end, wherein the upstream end of the fourth stator vane is bent at a fourth angle with respect to the nozzle axis. Preferably, the fourth angle is equal to the first angle. In some cases, the upstream end of the fourth stator vane is bent in a direction opposite the bend of the upstream end of the first stator vane, with respect to the nozzle axis. In some embodiments, the nozzle assembly includes a cross-vane having an upstream end and a downstream end. The cross-vane can separate the nozzle interior into a first nozzle chamber and a second nozzle chamber. In some embodiments, the first stator vane is positioned within the first nozzle chamber and the fourth stator vane is positioned within the second nozzle chamber. In some embodiments, the air moving device includes an outer housing having a housing inlet, a housing outlet, and a housing interior between the housing inlet and the housing outlet. In some cases, each of the impeller assembly and the nozzle assembly are positioned at least partially within the housing interior. In some embodiments, during a single revolution of the first and second impeller blades about the axis of rotation of the impeller, the first impeller blade passes the first stator vane before passing the second stator vane. In some embodiments, during a single revolution of the first and second impeller blades about the axis of rotation of the impeller, the first impeller blade passes the first stator vane before passing the third stator vane.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENTS

Figure 1:
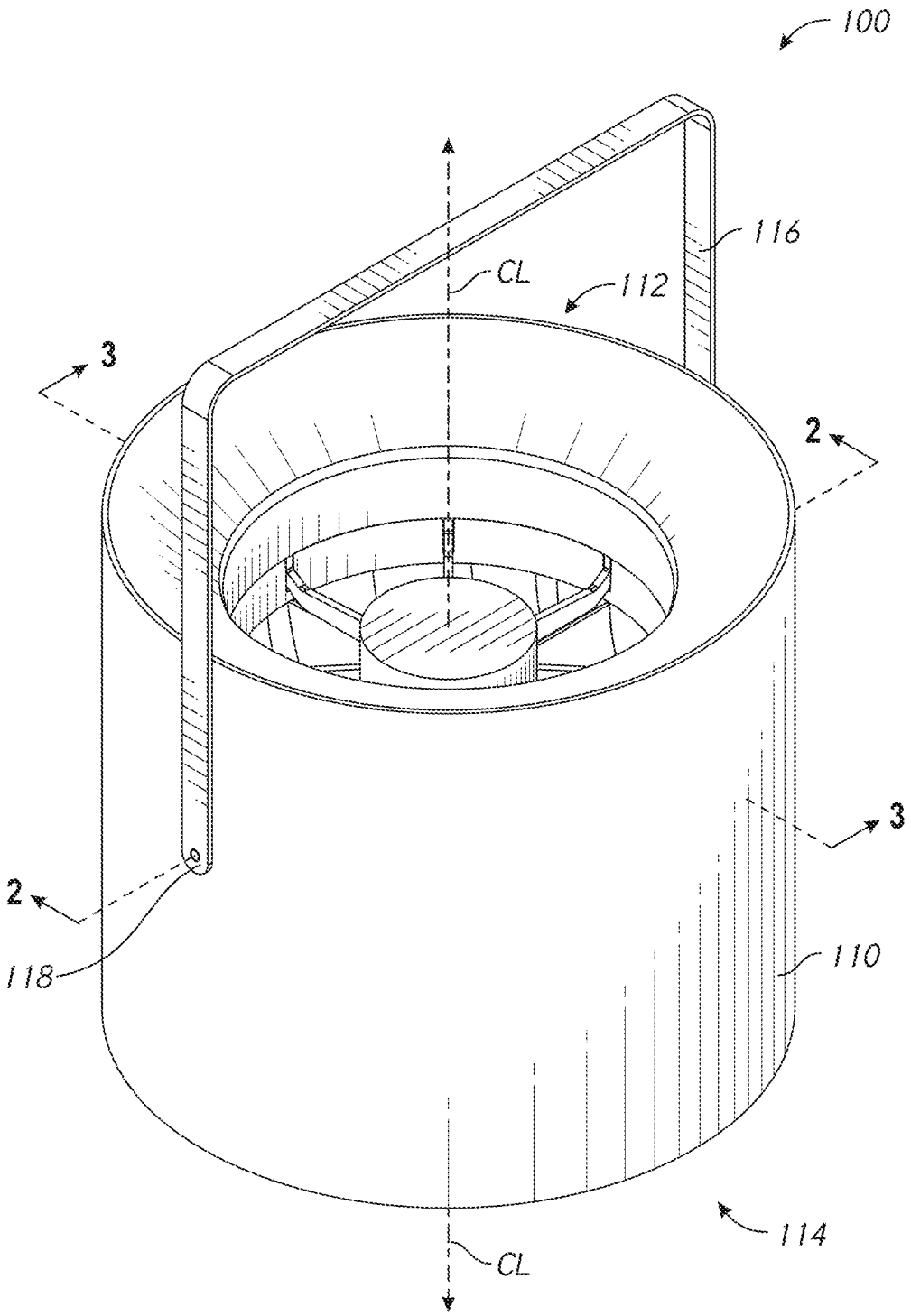
FIG. 1 is a top perspective view of an air moving device in accordance with an embodiment.

As illustrated in FIG. 1, an air moving device 100 can include an outer housing 110. The outer housing 110 can have a generally cylindrical shape, though other shapes are possible. For example, the outer housing 110 can have an annularly symmetric shape with varying diameters along a length of the outer housing 110. The air moving device 100 can have an inlet 112 and an outlet 114. As illustrated, the air moving device 100 can have a central axis CL extending through the air moving device 100 between the inlet 112 and the outlet 114.

A hanger 116 may be attached to the outer housing 110. For example, the hanger 116 may be hingedly attached to the outer housing 110 via one or more hinge points 118. The hanger 116 can facilitate installation of the air moving device 100 at or near a ceiling or other structure within an enclosure (e.g., a warehouse, retail store, grocery store, home, etc.). Further, the hanger 116 may advantageously space the inlet 112 from a mounting surface (e.g., a ceiling or other mounting surface). The hinged connection between the hanger 116 and the outer housing 110 can permit tilting of the air moving device 100 about the hinge points 118 before and/or after installation of the air moving device 100. In certain embodiments, no hanger may be used.

As illustrated in FIGS. 2A-3B, the air moving device 100 can include a nozzle assembly 120. The nozzle assembly 120 can include an inner housing 122. The inner housing 122 can be attached to the outer housing 110. In some embodiments, the inner housing 122 is positioned entirely within the outer housing 110. In some embodiments, a portion of the inner housing 122 extends out from the inlet 112 and/or from the outlet 114 of the outer housing 110. In some applications, the air moving device 100 does not include an outer housing 110. In some such cases, the hanger 116 is attached directly to the inner housing 122.

Figure 3A:
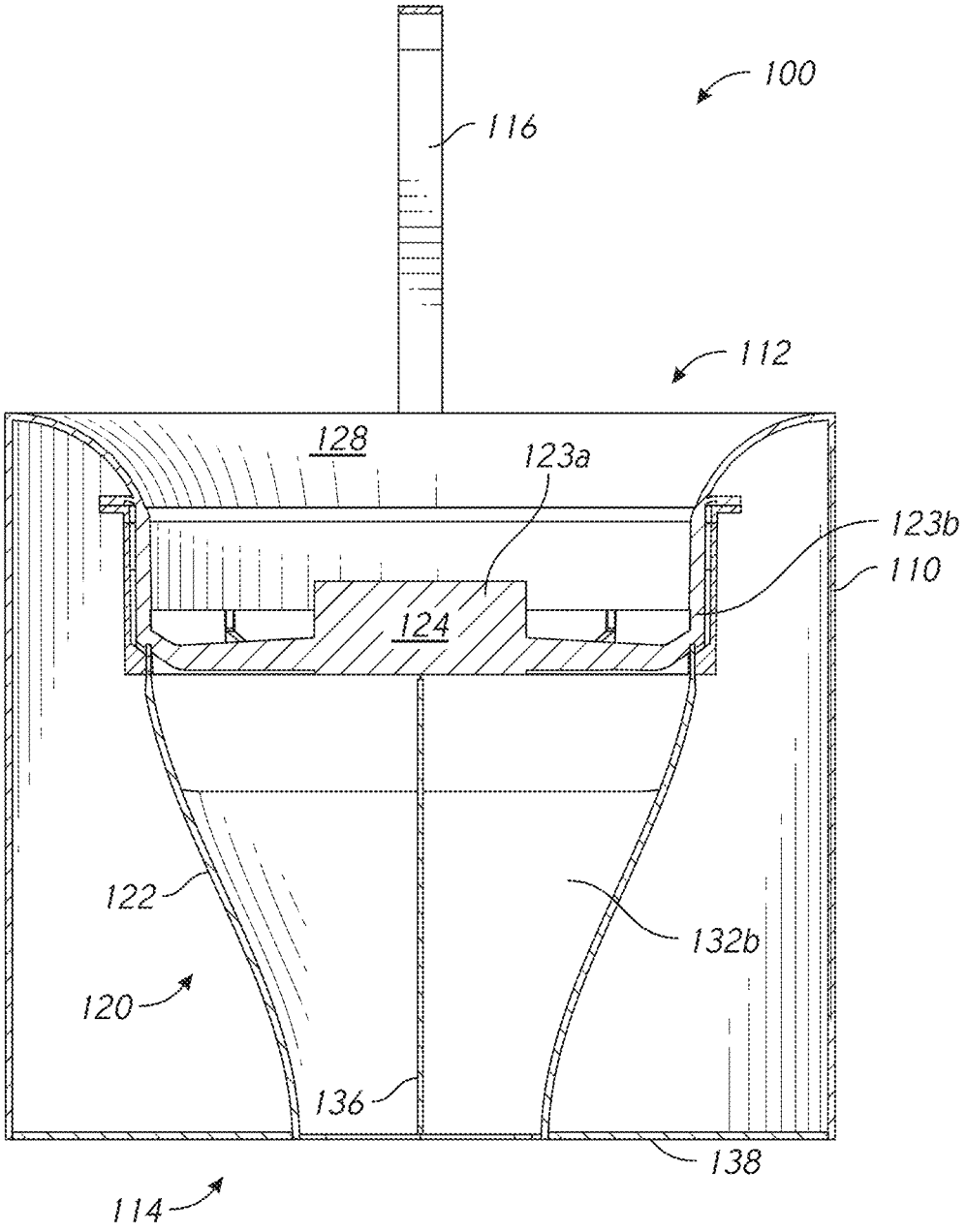
FIG. 3A is a cross-sectional view of the device of FIG. 1, taken along line 3-3 in FIG. 1.

The air moving device 100 can include an impeller 124. The impeller 124 can be positioned at least partially within the inner housing 122. As illustrated, the impeller 124 can be positioned within an impeller housing 125. In some embodiments, the impeller housing 125 and inner housing 122 form a single and/or monolithic part. The impeller 124 can be configured to rotate one or more impeller blades 126. The impeller blades 126 can be fixed to a hub 123*a* of the impeller 124. In some embodiments, as illustrated in FIG. 3A, the impeller blades 126 are fixed to the hub 123*a* of the impeller 124 and fixed to an outer impeller body portion 123*b*. An axis of rotation of the impeller 124 can be substantially parallel to the central axis CL of the air moving device 100. For example, the impeller 124 and impeller blades 126 can act as an axial compressor within the air moving device 100 when the air moving device 100 is in operation. The impeller 124 can be configured to operate at varying power levels. For example, the impeller 124 can operate between 5 and 10 watts, between 7 and 15 watts, between 12 and 25 watts, and/or between 20 and 50 watts. In some embodiments, the impeller 124 is configured to operate at a power greater than 5 watts, greater than 10 watts, greater than 15 watts, and/or greater than 25 watts. Many variations are possible. In some cases, the power usage and/or size of the impeller used is determined by the height at which the air moving device 100 is installed within an enclosure. For example, higher-powered impellers 124 can be used for air moving devices 100 installed further from the floor of an enclosure.

Figure 2A:
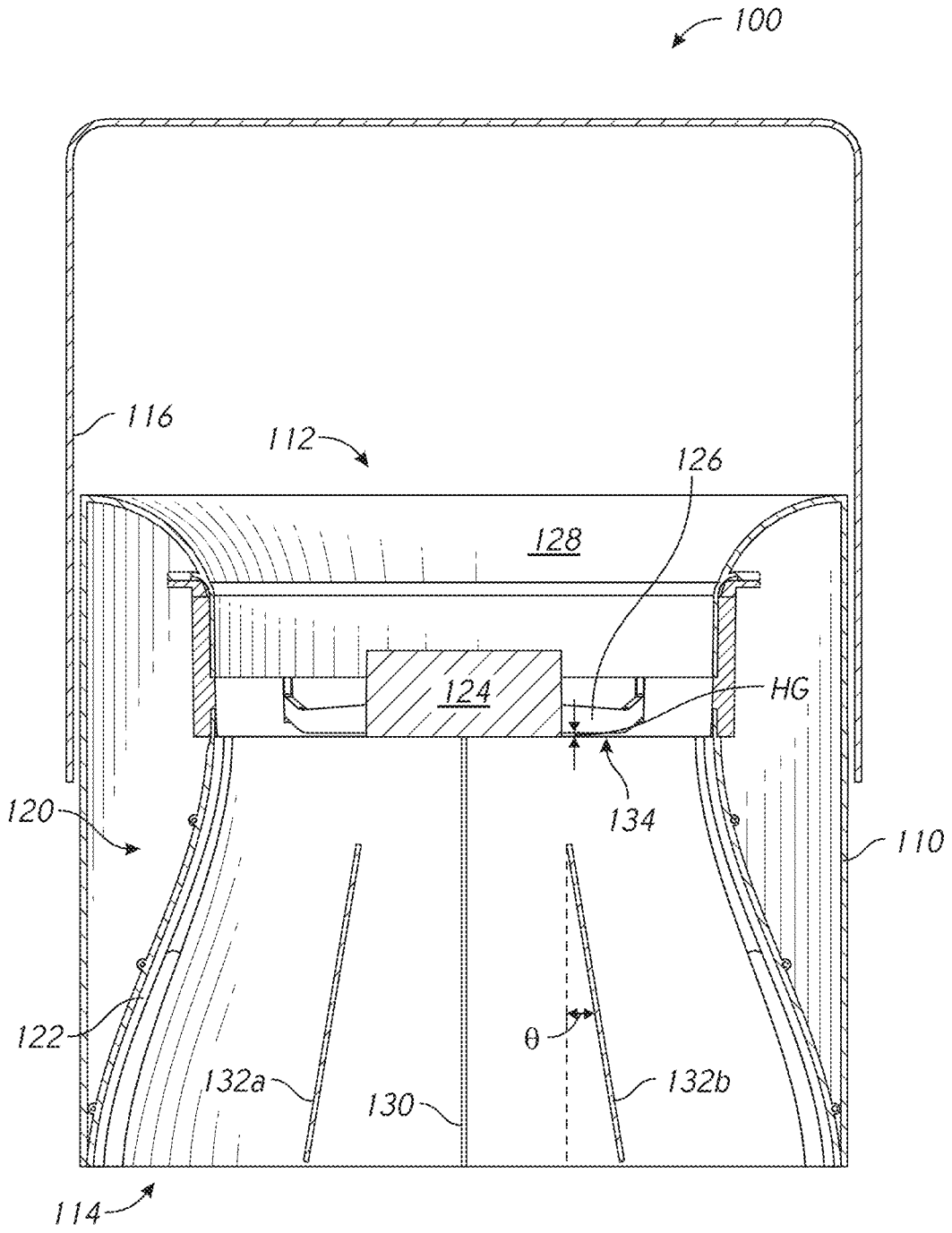
FIG. 2A is a cross-sectional view of the device of FIG. 1, taken along line 2-2 in FIG. 1.

The inlet 112 can include an inlet 112 cowl. The inlet 112 cowl can be sized and shaped to reduce turbulence of flow of air entering inlet 112 of the air moving device 100. For example, as illustrated in FIG. 2A, the inlet cowl 128 can have a curved shape. The curved shape of the inlet cowl 128 can extend from an outer perimeter of the inlet 112 to an inlet to the impeller housing 125. The curved shape of the inlet cowl 128 can reduce the amount of sharp corners or other turbulence-inducing features faced by air approaching the impeller 124 from the inlet 112.

In some embodiments, the nozzle assembly 120 includes one or more stator vanes. For example, as illustrated, the nozzle assembly 120 can include a center vane 130. The center vane 130 can be planar, and/or parallel to the central axis of the air moving device 100. The center vane 130 can be positioned in a substantial center of the nozzle assembly 120 as measured on the plane of FIG. 2A.

The nozzle assembly 120 can include one or more angled vanes 132*a*, 132*b*. The angled vanes 132*a*, 132*b* can be planar (e.g., straight) and/or curved (e.g., S-shaped, double-angled, etc.). In some embodiments, the nozzle assembly 120 includes one angled vane on each side of the center vane 130. In some embodiments, more than one angled vane is positioned on each side of the center vane 130. Many variations are possible. The angle θ of the angled vanes 132*a*, 132*b* with respect to the central axis CL of the air moving device 100 can be greater than or equal to 5°, greater than or equal to 10°, greater than or equal to 15°, greater than or equal to 25°, and/or greater than or equal to 45°. In some cases, the angle θ of the angled vanes 132*a*, 132*b* with respect to the central axis CL of the air moving device 100 is between 5° and 65°. Many variations are possible. In some embodiments, the nozzle assembly 120 has an even number of stator vanes. In some cases, the nozzle assembly 120 does not include a center vane 130 and only includes one or more angled vanes. The air moving device 100 can be constructed such that the nozzle assembly 120 is modular with respect to one or more of the other components of the air moving device 100. For example, in some embodiments, a nozzle assembly 120 can be removed from the air moving device 100 and replaced with another nozzle assembly 120 (e.g., a nozzle assembly having a larger outlet, a smaller outlet, more or fewer stator vanes, greater or lesser vane angles, etc.). In some cases, the inner housing 122 of the nozzle assembly 120 is constructed in two halves, each half connected to the other half via one or more fasteners 127 or other fastening devices. In some such cases, the two halves of the inner housing 122 can be separated to permit replacement of one or more of the stator vanes 130, 132*a*, 132*b*.

Figure 3B:
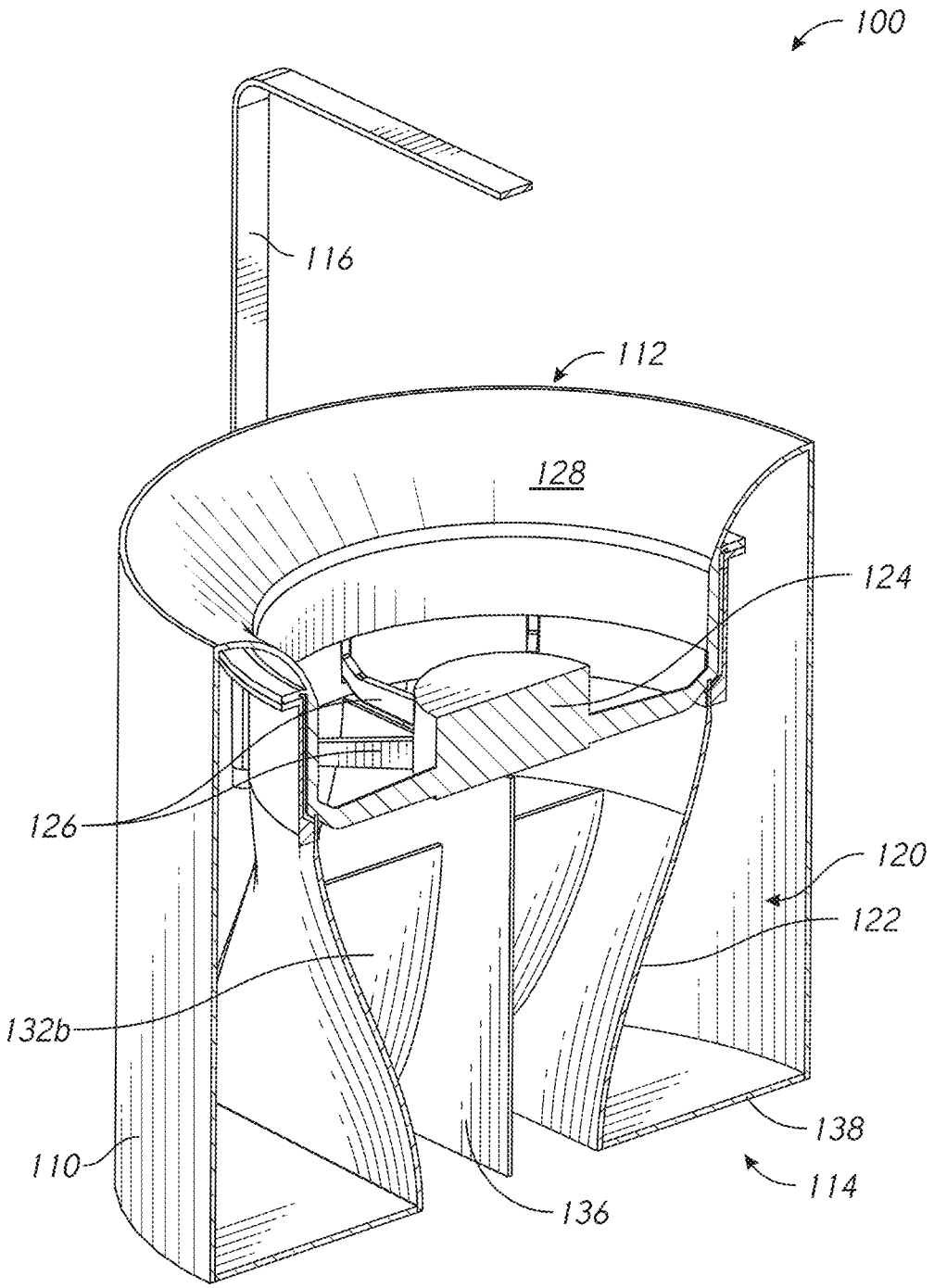
FIG. 3B is a top perspective cross-sectional view of the device of FIG. 1, taken along line 3-3 in FIG. 1.

Referencing FIGS. 3A-3B, the nozzle assembly 120 can include one or more cross-vanes 136. The one or more cross-vanes 136 can be planar and/or curved. The one or more cross-vanes may be positioned within the nozzle assembly 120 perpendicular to one or more of the vanes 130, 132*a*, 132*b*. For example, the nozzle assembly 120 can include a single cross-vane 136 that is substantially perpendicular to the center vane 130. The cross-vane 136 can be positioned in a substantial center of the nozzle assembly 120 as measured on the plane of FIG. 3A.

Figure 4:
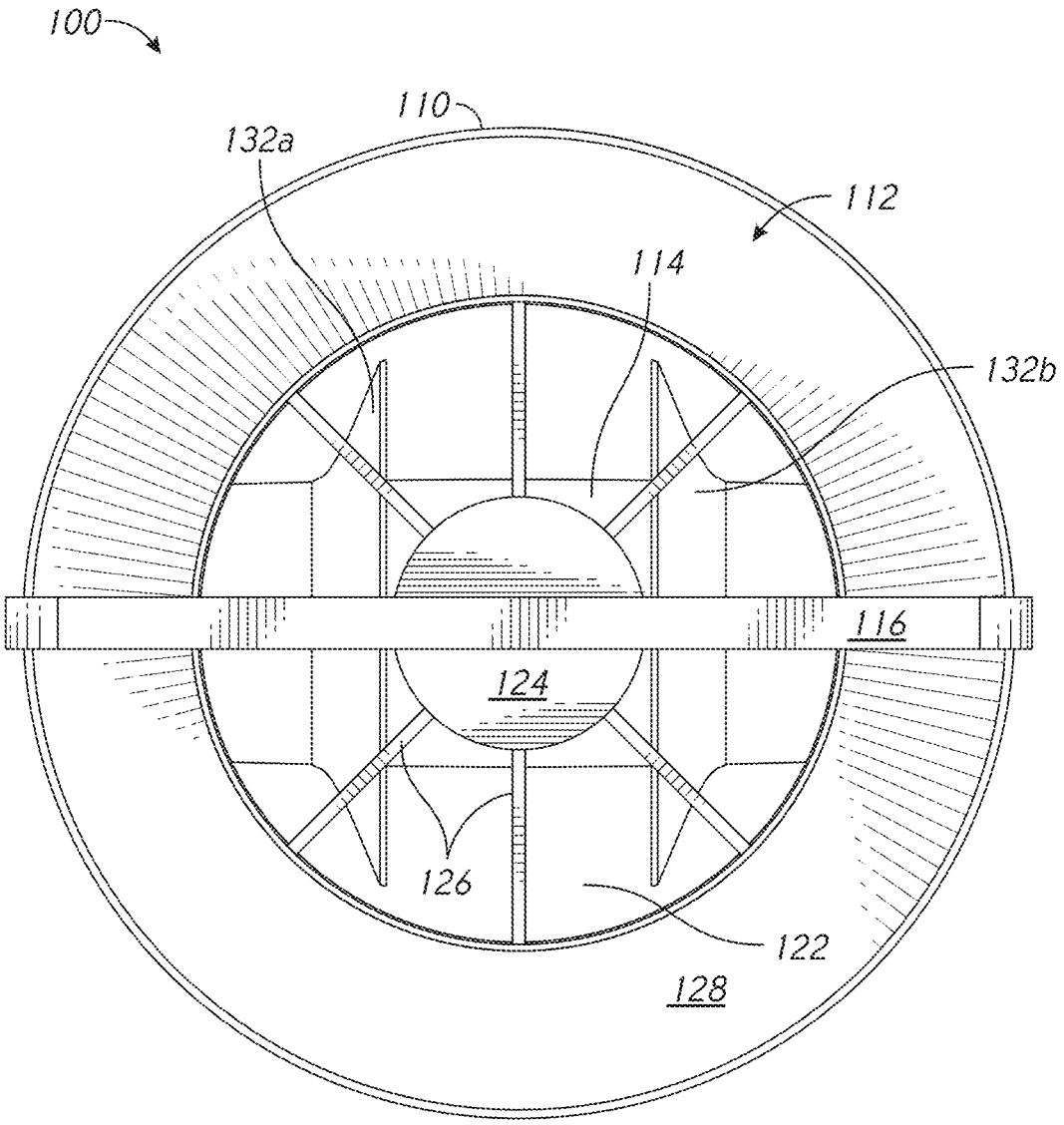
FIG. 4 is a top plan view of the device of FIG. 1.
Figure 5:
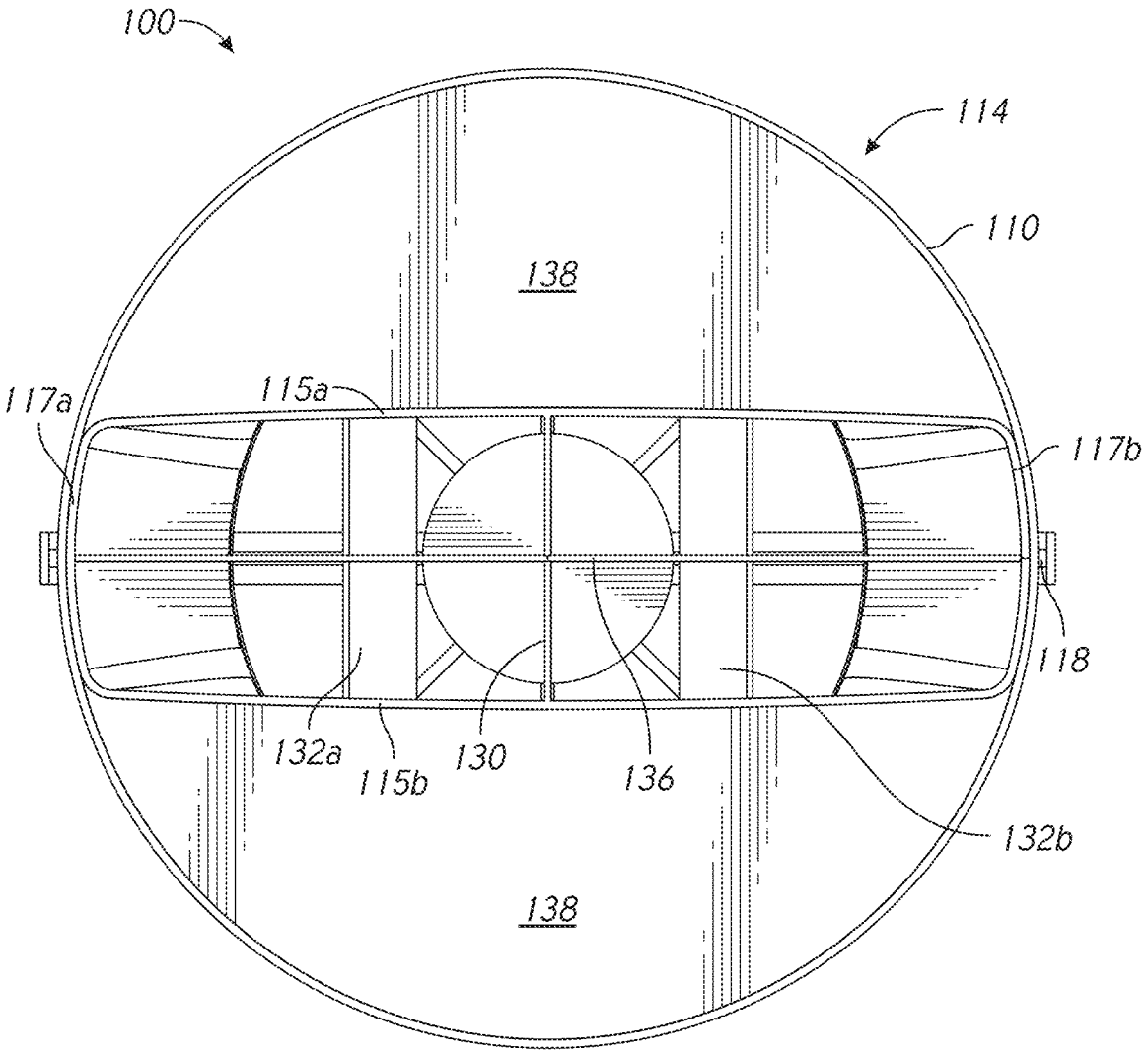
FIG. 5 is a bottom plan view of the device of FIG. 1.

As illustrated in FIG. 4, the inlet 112 of the air moving device 100 can have a substantially circular cross-section. In some case, an upstream end or inlet (e.g., the upper end with respect to FIG. 2A) of the nozzle assembly 120 has a substantially circular cross-section. In some embodiments, as illustrated in FIG. 5, the outlet 114 of the air moving device 100 (e.g., the outlet of the nozzle assembly 120) has a substantially rectangular, oval-shaped, and/or oblong cross-section. For example, the outlet of the nozzle assembly 120 can have a pair of long sides 115*a*, 115*b* and a pair of short sides 117*a*, 117*b*. Each of the long sides 115*a*, 115*b* can be substantially identical in length. In some embodiments, each of the short sides 117*a*, 117*b* are substantially identical in length. The length of the short sides 117*a*, 117*b* can be substantially equal to a length of a minor axis of the oblong shape of the outlet of the nozzle assembly 120. In some embodiments, the length of the long sides 115*a*, 115*b* of the outlet of the nozzle assembly 120 is substantially equal to a length of a major axis of the oblong shape of the outlet of the nozzle assembly 120. The length of the short sides 117*a*, 117*b* can be less than or equal to ⅛, less than or equal to ⅙, less than or equal to ¼, less than or equal to ⅓, less than or equal to ½, less than or equal to ⅝, less than or equal to ¾, and/or less than or equal to 9/10 of the length of the long sides 115*a*, 115*b*. In some cases, the length of the short sides 117*a*, 117*b* is between ⅛ and ½, between ⅓ and ¾, and/or between ⅜ and 9/10 of the length of the long sides 115*a*, 115*b*. Many variations are possible. In some embodiments, the outlet of the nozzle assembly can be elliptical or rectangular in shape.

The cross-sectional area of the outlet of the nozzle assembly 120 is less than or equal to 95%, less than or equal to 90%, less than or equal to 85%, less than or equal to 75% and/or less than or equal to 50% of the cross-sectional area of the inlet of the nozzle assembly 120. In some embodiments, the cross-sectional area of the outlet of the nozzle assembly 120 is between 75% and 95%, between 55% and 85%, between 70% and 90%, and/or between 30% and 60% of the cross-sectional area of the inlet of the nozzle assembly 120. Many variations are possible.

Figure 2B:
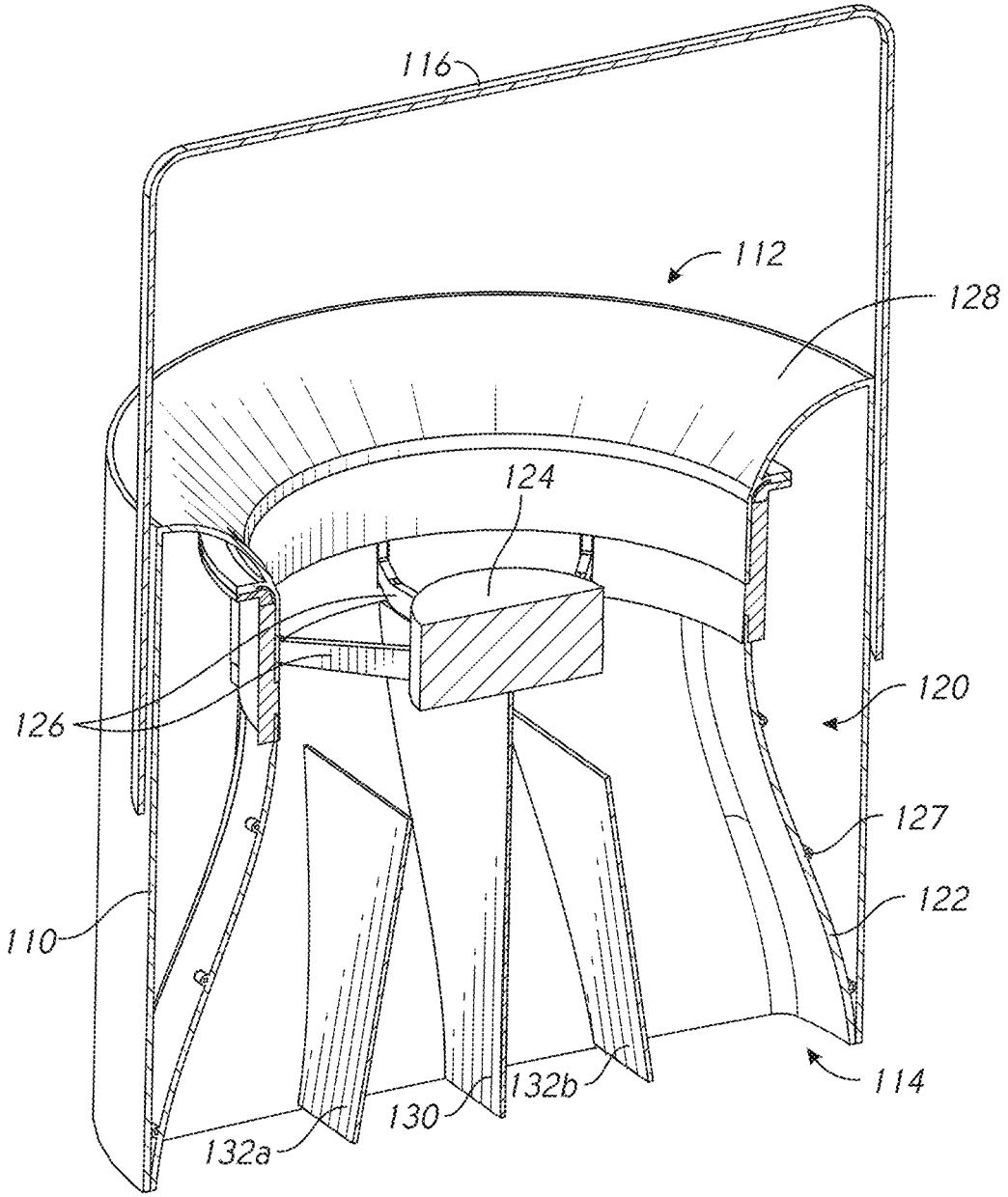
FIG. 2B is a top perspective cross-sectional view of the device of FIG. 1, taken along line 2-2 in FIG. 1.

As illustrated in FIGS. 2B and 5, the hanger 116 can be connected to the outer housing 110 at hinge points 118 having an axis of rotation generally perpendicular to the center vane 130 (e.g., generally parallel to the major axis of the outlet to the nozzle assembly 120). In some such arrangements, the air moving device 100 can be mounted offset from a centerline of an aisle and rotated about the hinge points 118 to direct air toward the center of the floor of the aisle. For example, the air moving device 100 can be installed adjacent to a light fixture, where the light fixture is positioned over a centerline of the aisle.

In some embodiments, the nozzle assembly 120 can be rotatable within the outer housing 110. For example, the nozzle assembly 120 can be rotated about the axis of rotation of the impeller 124 with respect to the hanger 116. In some such embodiments, the nozzle assembly 120 can be releasable or fixedly attached to the outer housing 110 in a plurality of rotational orientations. For example, the inner housing 122 and/or nozzle assembly 120 can be installed in the outer housing 110 such that the axis of rotation of the hanger 116 is generally perpendicular to the major axis of the outlet of the nozzle assembly 120.

In some embodiments, the air moving device 100 includes one or more bezels 138. The bezels 138 can be positioned between the inner housing 122 and the outer housing 110 at the outlet 114 of the air moving device 100. For example, the bezels 138 can be positioned between the oblong wall of the outlet 114 of the air moving device 100 and the substantially circular wall of the outer housing 110 adjacent the outlet 114. The bezels 138 can provide structural stability at the outlet end 114 of the air moving device 100. For example, the bezels 138 can reduce or eliminate later motion (e.g., motion transverse to the central axis CL of the air moving device 100) between the outlet of the nozzle assembly 120 and the outlet end of the outer housing 110. The bezels 138 can be configured to be interchangeable. For example, the bezels 138 can be replaced with bezels of varying sizes and shapes to correspond with nozzle outlets of various sizes and shapes. In some cases, interchangeable bezels can be mounted adjacent the nozzle inlet to correspond to nozzle inlets having various sizes and shapes.

As illustrated in FIG. 2A, a gap 134 between the impeller blades 126 and one or more of the vanes can be small. For example, a height HG (measured parallel to the axis of rotation of the impeller 124) of the gap 134 between the downstream edge of the impeller blades 126 and an upstream edge of one or more of the stator vanes can be proportional to the diameter of the impeller 124 (e.g., diameter to the tip of the impeller blades 126). Preferably, the height HG of the gap 134 is less than or equal to one half the diameter of the impeller 124.

Figure 6A:
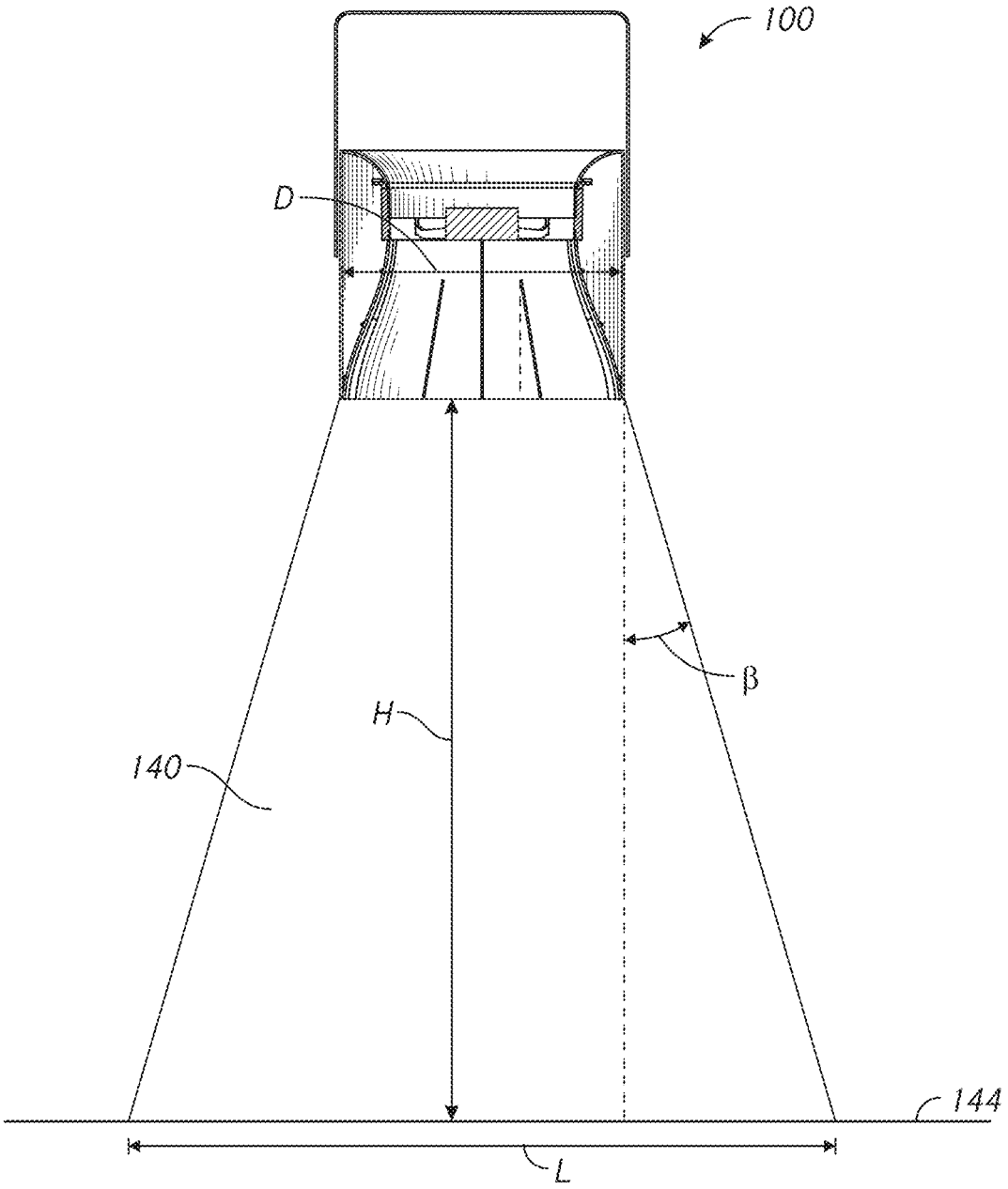
FIG. 6A is a cross-sectional view of the device of FIG. 1, taken along line 2-2 in FIG. 1, and a column of moving air leaving an outlet of the device.
Figure 6B:
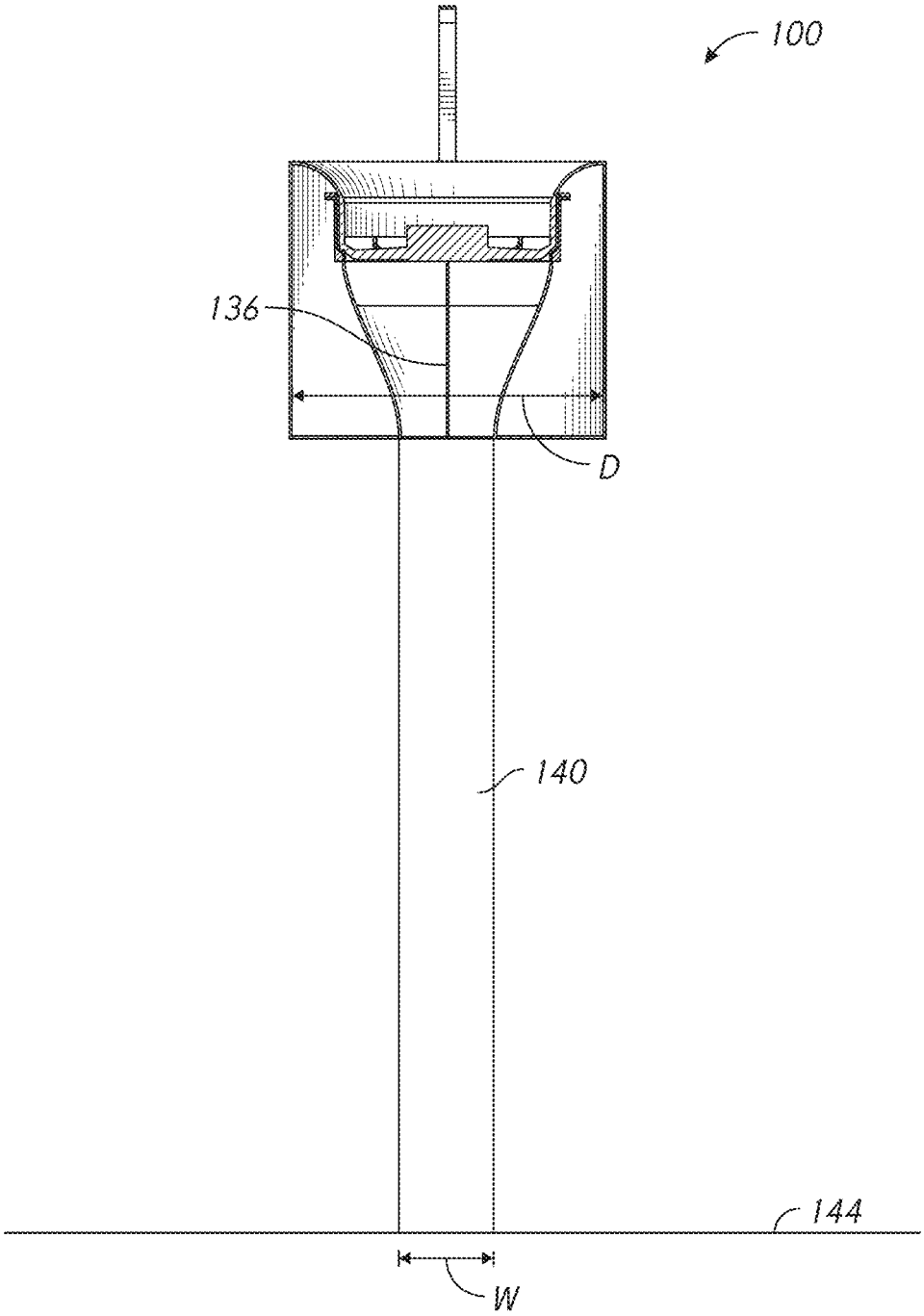
FIG. 6B is a cross-sectional view of the device of FIG. 1, taken along line 3-3 in FIG. 1, and a column of moving air leaving an outlet of the device.
Figure 7:
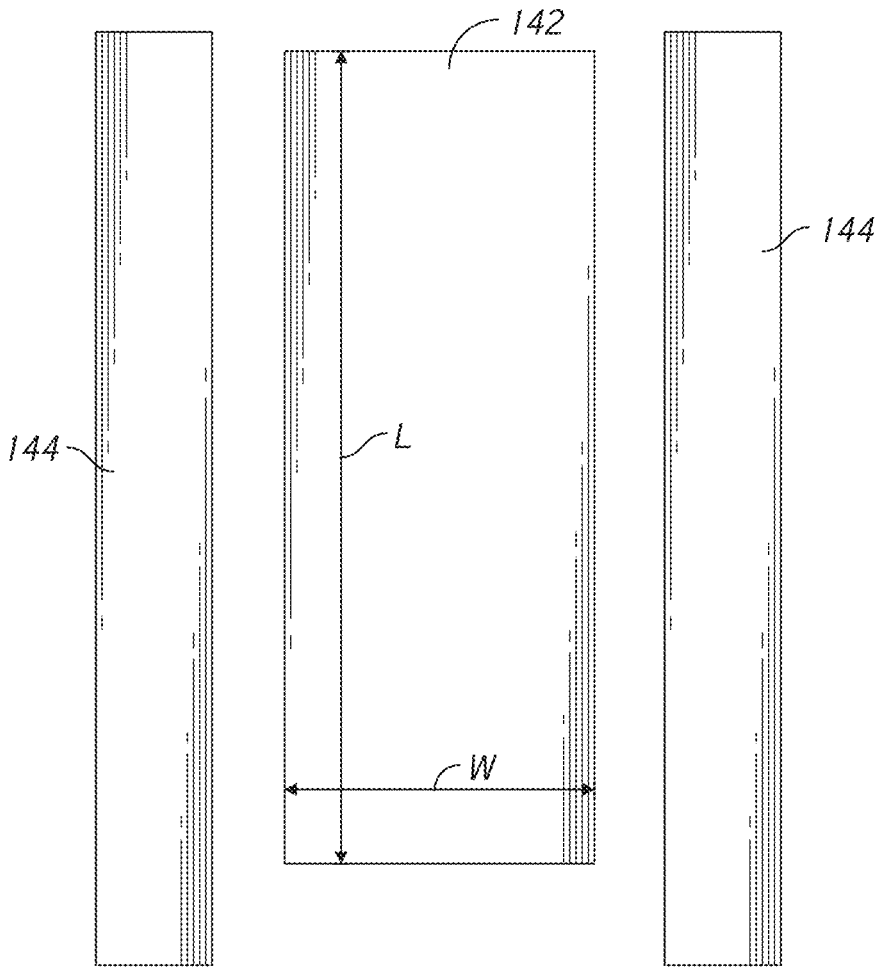
FIG. 7 is a top plan view of a dispersion pattern of the column of moving air which impinges the floor of an enclosure.

Referring to FIGS. 6A and 6B, the air moving device 100 can be configured to output a column of air 140. The column of moving air 140 can extend out from the outlet 114 of the air moving device 100. In some embodiments, the column of moving air 140 flairs outward in a first direction while maintaining a substantially constant width in a second direction. For example, the column of moving air 140 may flair outward from the central axis CL of the air moving device in a plane parallel to the plane of the cross-vane 136 (e.g., the plane of FIG. 6A). The column of moving air 140 can flair out at an angle β with respect to the central axis CL of the air moving device 100. Angle β can be greater than or equal to 3°, greater than or equal to 7°, greater than or equal to 15°, greater than or equal to 25°, and/or greater than or equal to 45°. In some embodiments, angle β is between 2° and 15°, between 8° and 25°, between 20° and 45°, and/or between 30° and 60°. Many variations are possible. The angle β of the column of moving air 140 can be proportional to the angle θ of the angled vanes 132*a*, 132*b*. For example, increasing the angle θ of the angled vanes 132*a*, 132*b* can increase the angle β of the column of moving air 140 (e.g., to widen the column of moving air 140). In some cases, reducing the angle θ of the angled vanes 132*a*, 132*b* can reduce the angle β of the column of moving air 140. As illustrated in FIG. 6B, the column of moving air 140 may have a generally columnar (e.g., vertical or non-flaring) pattern in a plane perpendicular to the plane of the cross-vane 136 (e.g., the plane of FIG. 6B).

In some embodiments, the dispersion pattern 142 of the air column 140 which impinges the floor 144 of the enclosure in which the air moving device 100 is installed has a width W and a length L. The length L can be greater than the diameter D or cross-sectional width of the air moving device 100, as illustrated in FIG. 6A. For example, the length L of the dispersion pattern 142 can be greater than or equal to 1.1 times, greater than or equal to 1.3 times, greater than or equal to 1.5 times, greater than or equal to 1.7 times, greater than or equal to 2 times, greater than or equal to 2.3 times, greater than or equal to 2.7 times, and/or greater than or equal to 4 times the diameter D of the air moving device 100. In some cases, the length L of the dispersion pattern 142 is between 1 and 1.8 times greater, between 1.7 and 2.9 times greater, and/or between 2.7 and 5 times greater than the diameter D of the air moving device 100.

In some embodiments, the width W is less than or equal to the diameter of the air moving device 100, as illustrated in FIG. 6B. For example the width W of the dispersion pattern 142 can be between ¼ and ¾, between ½ and ⅞, and/or between ¾ and 9/10 of the diameter D of the air moving device 100. In some cases, the width W of the dispersion pattern 142 is greater than the diameter D of the air moving device 100 (e.g., when the column of moving air 140 expands at a distance from the outlet 114 of the air moving device 100). For example, the width W of the dispersion pattern can be between 1 and 1.4 times, between 1.3 and 1.8 times, and/or between 1.5 and 2.5 times the diameter D of the air moving device 100. The width W can be sized and shaped to fit between two or more storage units 144 (e.g., within an aisle) in a grocery store or other retail setting. In some cases, the width W is less than ⅛, less than ¼, less than ⅓, less than ½, less than ⅔, less than ¾, and/or less than 9/10 of the length L of the dispersion pattern 142. The width W can be between 1/10 and ¼, between ⅛ and ⅓, between ½ and ¾, and/or between ⅝ and 9/10 of the length of the dispersion pattern 142. Many variations are possible. Each of the above ratios between the width W of the dispersion pattern 142, the length L of the dispersion pattern 142, and the diameter D of the air moving device 100 can be attained when the air moving device 100 is mounted at a given height H from the floor 144. For example, the height H can be between 8 feet and 12 feet, between 10 feet and 15 feet, between 14 feet and 20 feet, and/or between 18 feet and 40 feet. At a given height, the angles θ of the angled vanes 132*a*, 132*b* can be modified to modify the ratio between the width W of the dispersion pattern 142, the length L of the dispersion pattern 142, and the diameter D of the air moving device 100.

A user of the air moving device 100 can vary the first width W1 of the dispersion pattern 142. For example, the user can increase the height H at which the air moving device 100 is installed within the enclosure. Increasing the height H can increase the distance over which the column of moving air 140 flairs outward, increasing the width W1. Conversely, decreasing the height H can decrease the width W1 of the dispersion pattern 142.

Figure 8:
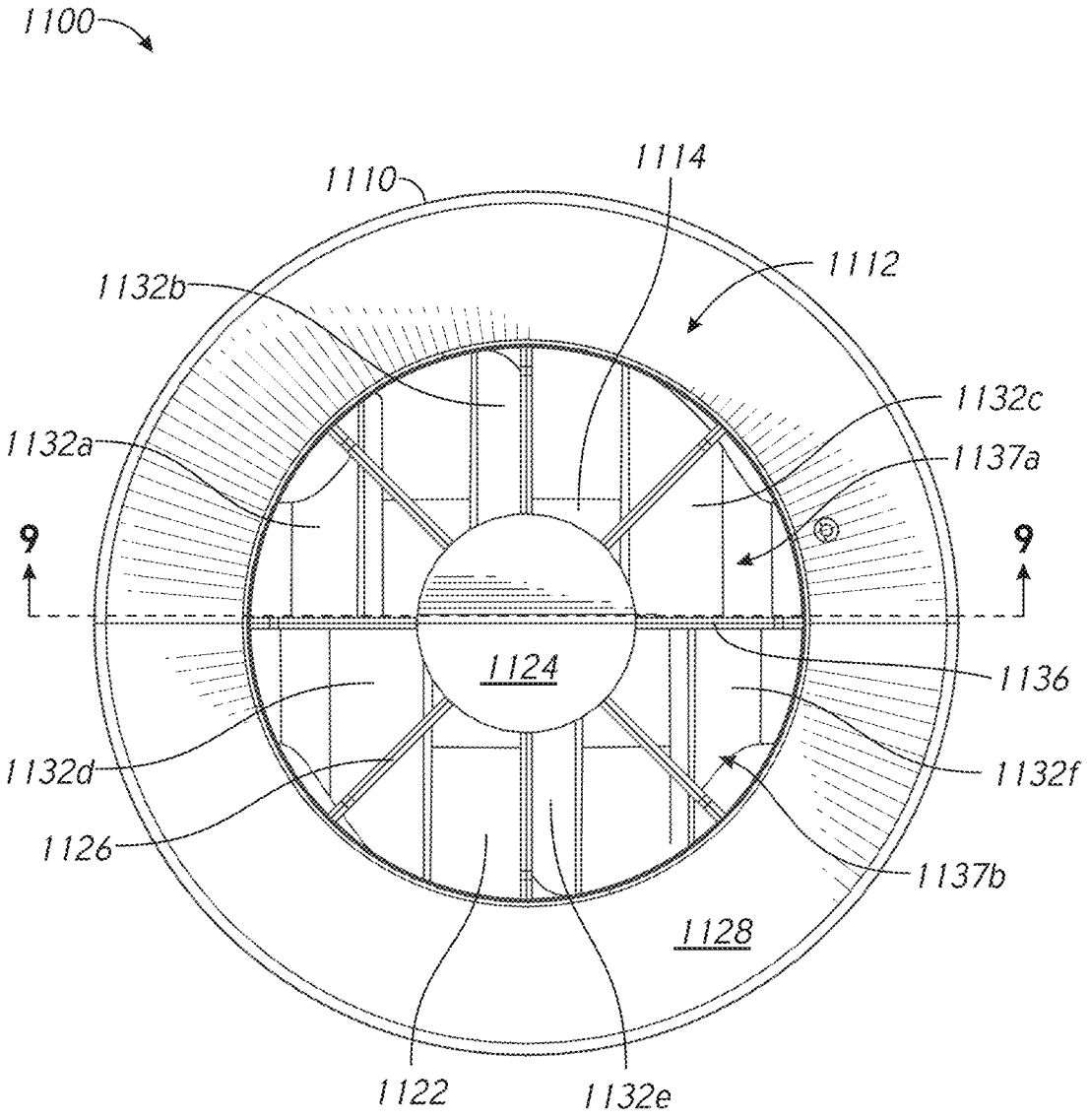
FIG. 8 is a top plan view of an embodiment of an air moving device wherein one or more of the stator vanes has a bent upstream end.
Figure 9:
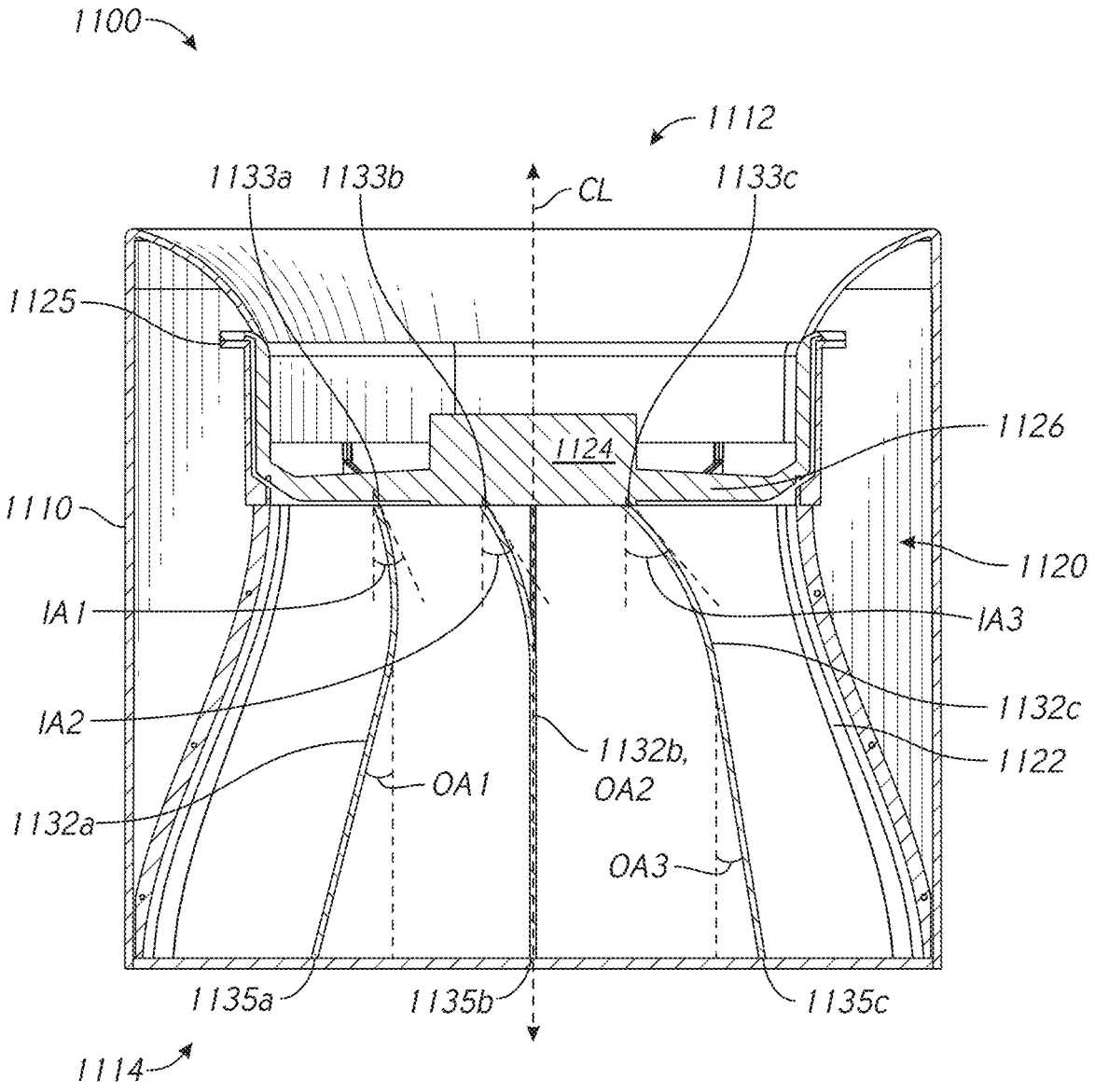
FIG. 9 is a cross-sectional view of the device of FIG. 8, taken along the line 9-9 of FIG. 8.

FIGS. 8 and 9 illustrate an embodiment of an air moving device 1100. Numerical reference to components is the same as previously described, except that the number "1" has been added to the beginning of each reference. Where such references occur, it is to be understood that the components are the same or substantially similar previously-described components unless otherwise indicated. For example, in some embodiments, the impeller 1124 of the air moving device 1100 can be the same or substantially similar in structure and/or function to the impeller 124 of the air moving device 100 described above. The air moving device 1100 can include a hanger (not shown) having the same or a similar structure to the hanger 116 described above.

As illustrated in FIGS. 8 and 9 the air moving device 1100 can include a plurality of stator blades 1132*a*, 1132*b*, 1132*c*, 1132*d*, 1132*e*, and/or 1132*f* (hereinafter, collectively referred to as stator blades 1132). Each of the stator blades 1132 can include an upstream end 1133 and a downstream end 1135 (hereinafter, specific upstream and downstream ends of specific stator blades are identified by like letters, e.g., upstream and downstream ends 1133*a*, 1135*a* of stator blade 1132*a*). In some cases, the upstream end(s) of one or more of the stator blades 1132 is curved away from or bent at an angle with respect to the axis of rotation of the impeller 1124. In some embodiments, the axis of rotation of the impeller 1124 is parallel to and/or collinear with the central axis CL (e.g., nozzle axis) of the air moving device 1100. The upstream end(s) of one or more of the stator blades 1132 can be curved away from or bent to reduce the angle of attack on the upstream end of the stator blade of the air exiting the impeller 1124. Reducing the angle of attack on the upstream end of the stator blade of the air exiting the impeller 1124 can reduce turbulent flow within the device 1100. Reducing turbulent flow in the device 1100 can reduce noise and/or increase efficiency (e.g., exit flow rate compared to electricity used) of the device 1100.

In some embodiments, the bent upstream portions of the stator blades 1132 are curved away from or bent in directions parallel to the cross-vane 1136 of the nozzle assembly 1120. For example, the cross-vane 1136 can separate the interior of the nozzle assembly 1120 (e.g., the interior of the inner housing 1122) into two separate chambers 1137*a*, 1137*b*. In some cases, multiple cross-vanes separate the interior of the nozzle assembly into three or more separate chambers. As illustrated, the first, second, and third stator vanes 1132*a-c* are positioned in one chamber (e.g., first chamber 1137*a*) of the interior of the nozzle and the fourth, fifth, and sixth stator vanes 1132*d-f* are positioned in another chamber (e.g., second chamber 1137*b*) of the interior of the nozzle. The stator vanes positioned on one side of cross-vane 1136 (e.g., in a first chamber of the nozzle interior) are curved or bent in a direction opposite the direction in which the stator vanes positioned on the opposite side of the cross-vane 1136 (e.g., in a second chamber of the nozzle interior) are curved or bent.

As illustrated, the impeller 1124 of the air moving device 1100 is configured to rotate in the clockwise direction (e.g., in the frame of reference of the plane of FIG. 8) about the axis of rotation of the impeller 1124 when moving air into the inlet 1112 and out through the outlet 1114 of the device 1100. The cross-vane lateral component of the air exiting the impeller 1124 can be defined as the velocity component parallel to the cross-vane 1136 and perpendicular to the axis of rotation of the impeller 1124. The cross-vane lateral component of the air exiting a given rotor blade 1126 can changer as the blade 1126 rotates about the axis of rotation of the impeller 1124. For example, the cross-vane lateral component of the air exiting a given rotor blade can be close to zero as the rotor blade passes the cross-vane 1136. The cross-vane lateral component of the air exiting the given rotor blade will increase as the rotor blade continues to move about the axis of rotation of the impeller 1124, before diminishing as the impeller blade approaches the cross-vane 1136 on an opposite side of the device 1100 from the point at which the impeller blade had previously crossed the cross-vane 1136.

As illustrated in FIG. 9, one or more of the stator vanes 1132 can be curved or bent at their respective first ends 1133 to an inlet angle. For example, the inlet end 1133*a* of the first stator vane 1132*a* can be curved or bent to a first inlet angle IA1. The inlet end 1133*b* of the second stator vane 1132*b* can be curved or bent to a second inlet angle IA2. The inlet end 1133*c* of the third stator vane 1132*c* can be curved or bent to a third inlet angle IA3. As illustrated, in some cases, the first inlet angle IA1 is less than the second inlet angle IA2. In some cases, the first inlet angle IA1 is less than the third inlet angle IA3. In some cases, the second inlet angle IA2 is less than the third angle IA3.

In some embodiments, the downstream end 1135 of one or more of the stator vanes 1132 is angled with respect to (e.g., bent and/or curved away from) the axis of rotation of the impeller 1124 by an outlet angle. For example, the downstream end 1135*a* of the first stator vane 1132*a* can be angled with respect to the axis of rotation of the impeller 1124 by an outlet angle OA1. The outlet end 1135*b* of the second stator vane 1132*b* can be angled with respect to the axis of rotation of the impeller 1124 by an outlet angle OA2. The outlet end 1135*c* of the third stator vane 1132*c* can be angled with respect to the axis of rotation of the impeller 1124 by an outlet angle OA3. One or more of the outlet angles (e.g., the outlet angle OA2 of the second stator vane 1132*b*) can be zero. In some cases, the outlet angles OA1, OA3 of the first and third stator vanes 1132*a*, 1132*c* are opposite each other such that the outlet ends 1135*a*, 1135*c* of the first and third stator vanes 1132*a*, 1132*c* flare outward or taper inward with respect to the axis of rotation of the impeller 1124. One or both of the outlet angles OA1, OA3 of the first and third stator vanes 1132*a*, 1132*c* can be similar to or equal to the angle θ of the angled vanes 132*a*, 132*b* with respect to the axis of rotation of the impeller 1124.

The stator vanes positioned within the second chamber 1137*b* of the interior of the nozzle assembly 1120 can have the same or similar construction and features of the stator vanes positioned within the first chamber 1137*a*, wherein the vanes in the second chamber 1137*b* are mirrored about the centerline CL of the device 1100 with respect to the vanes in the first chamber 1137*a*. For example, the fourth stator vane 1132*d* can have the same or a similar overall shape and position in the second chamber 1137*b* as the first stator vane 1132*a* has in the first chamber 1137*a*. The same can be true when comparing the fifth stator vane 1132*e* to the second stator vane 1132*b*, and/or when comparing the sixth stator vane 1132*f* to the third stator vane 1132*c*. In some embodiments, the angles of attack on the upstream ends of the stator vanes 1132*d-f* of the air exiting a given impeller blade as it passes the stator vanes 1132*d-f* are the same as or similar to the angles of attack on the upstream ends of the stator vanes 1132*a-c*, respectively, of the air exiting the impeller blade as it passes the stator vanes 1132*d-f*.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An air moving device comprising:

a housing comprising an outer housing and an inner housing, the inner housing coupled to the outer housing and positioned within the outer housing;

an impeller rotatably mounted at least partially within the inner housing and configured to move air through the housing;

a nozzle having an inlet and an outlet, the outlet comprising a first pair of sides and a second pair of sides, wherein the first pair of sides are shorter in length than the second pair of sides, and wherein a cross-sectional area of the outlet is less than the cross-sectional area of the inlet;

one or more stator vanes positioned within the nozzle; and at least one bezel positioned at or near the outlet of the nozzle between the inner housing and the outer housing.

2. The air moving device of claim 1, wherein the at least one bezel is removably connected to the air moving device.

3. The air moving device of claim 1, wherein the at least one bezel is positioned adjacent the outlet.

4. The air moving device of claim 1, further comprising two bezels.

5. The air moving device of claim 1, further comprising a hanger capable of attaching to the air moving device, the hanger configured to facilitate attachment of the air moving device to a ceiling or other structure.

6. The air moving device of claim 1, wherein the bezel is configured to reduce motion transverse to a central axis of the air moving device.

7. The air moving device of claim 1, wherein a diameter of the outer housing is generally constant, and a diameter of the inner housing varies.

8. The air moving device of claim 1, wherein each side of the first pair of sides are substantially identical in length and wherein each side of the second pair of sides are substantially identical in length.

9. An air moving device comprising:

a housing having a length and a width, wherein an outer diameter along the length of the housing is generally constant and an inner diameter along the length of the housing varies;

an impeller rotatably mounted at least partially within the housing and configured to move air through the housing;

a nozzle having an inlet and an outlet, the outlet comprising a first pair of sides and a second pair of sides, wherein the first pair of sides are shorter in length than the second pair of sides, and wherein a cross-sectional area of the outlet is less than the cross-sectional area of the inlet;

one or more stator vanes positioned within the nozzle; and at least one bezel positioned at or near the outlet of the nozzle.

10. The air moving device of claim 9, wherein the at least one bezel is removably connected to the air moving device.

11. The air moving device of claim 9, wherein the at least one bezel is positioned adjacent the outlet.

12. The air moving device of claim 9, further comprising two bezels.

13. The air moving device of claim 9, wherein the housing comprises an outer housing and an inner housing coupled with and positioned within the outer housing.

14. The air moving device of claim 9, further comprising a hanger capable of attaching to the air moving device, the hanger configured to facilitate attachment of the air moving device to a ceiling or other structure.

15. The air moving device of claim 9, wherein the bezel is configured to reduce motion transverse to a central axis of the air moving device.

16. The air moving device of claim 9, wherein each side of the first pair of sides are substantially identical in length and wherein each side of the second pair of sides are substantially identical in length.

* * * * *